US010199746B2

(12) United States Patent
Kim

(10) Patent No.: US 10,199,746 B2
(45) Date of Patent: Feb. 5, 2019

(54) ANTENNA APPARATUS, VEHICLE HAVING THE ANTENNA APPARATUS, AND METHOD FOR CONTROLLING THE ANTENNA APPARATUS

(71) Applicant: HYUNDAI MOTOR COMPANY, Seoul (KR)

(72) Inventor: Dongjin Kim, Seoul (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 326 days.

(21) Appl. No.: 15/163,207

(22) Filed: May 24, 2016

(65) Prior Publication Data

US 2017/0110790 A1 Apr. 20, 2017

(30) Foreign Application Priority Data

Oct. 15, 2015 (KR) ..... 10-2015-0144282

(51) Int. Cl.

| | |
|---|---|
| ***H01Q 3/24*** | (2006.01) |
| ***H01Q 21/29*** | (2006.01) |
| ***H01Q 21/20*** | (2006.01) |
| ***H01Q 1/32*** | (2006.01) |
| ***H01Q 21/00*** | (2006.01) |

(52) U.S. Cl.

CPC ..... *H01Q 21/293* (2013.01); *H01Q 1/3233* (2013.01); *H01Q 3/24* (2013.01); *H01Q 21/0062* (2013.01); *H01Q 21/205* (2013.01)

(58) Field of Classification Search

CPC ..... H01Q 21/293; H01Q 21/205; H01Q 21/0062; H01Q 1/3233; H01Q 3/24

USPC ..... 343/757

See application file for complete search history.

(56) References Cited

U.S. PATENT DOCUMENTS

| | | | | |
|---|---|---|---|---|
| 2007/0109198 | A1* | 5/2007 | Saban | H01Q 1/007 343/700 MS |
| 2014/0010156 | A1* | 1/2014 | Chuang | H04W 88/08 370/328 |
| 2015/0119968 | A1* | 4/2015 | Zschaeck | A61N 1/0472 607/139 |
| 2017/0110790 | A1* | 4/2017 | Kim | H01Q 21/205 |
| 2017/0179578 | A1* | 6/2017 | Semonov | H01Q 1/246 |

FOREIGN PATENT DOCUMENTS

| | | | |
|---|---|---|---|
| JP | 07-249926 | A | 9/1995 |
| JP | 2001-189619 | A | 7/2001 |
| JP | 2006-005645 | A | 1/2006 |

(Continued)

OTHER PUBLICATIONS

Korean Office Action dated Jul. 19, 2016, issued in Korean Patent Application No. 10-2015-0144282.

*Primary Examiner* — Lam T Mai

(74) *Attorney, Agent, or Firm* — McDermott Will & Emery LLP

(57) ABSTRACT

An antenna apparatus includes an omni-directional antenna for omni-directionally transmitting or receiving a signal, and a directional antenna module including a plurality of directional antennae having different radiation angles, wherein each of the directional antennae includes a feed unit to provide a signal, at least one waveguide through which the provided signal is propagated, and at least one radiation slot designed to radiate the signal propagated through the waveguide.

33 Claims, 30 Drawing Sheets

(56) References Cited

FOREIGN PATENT DOCUMENTS

| | | | |
|---|---|---|---|
| JP | 2013-201675 | A | 10/2013 |
| KR | 10-1993-0011773 | A | 12/1993 |
| KR | 10-2007-0072629 | A | 7/2007 |
| KR | 10-2013-0098098 | A | 9/2013 |

* cited by examiner

STANDBY MODE

DURING SIGNAL RECEPTION

DURING COMMUNICATION

ANTENNA APPARATUS, VEHICLE HAVING THE ANTENNA APPARATUS, AND METHOD FOR CONTROLLING THE ANTENNA APPARATUS

CROSS-REFERENCE TO RELATED APPLICATION

This application claims the benefit of priority to Korean Patent Application No. 10-2015-0144282, filed on Oct. 15, 2015 with the Korean Intellectual Property Office, the disclosure of which is incorporated herein by reference.

TECHNICAL FIELD

Embodiments of the present disclosure relate to an antenna apparatus for adjusting a directional pattern, a vehicle including the antenna apparatus, and a method for controlling the antenna apparatus.

BACKGROUND

Generally, if the position of an object acting as a communication object is changed or if scanning is needed to search for the position of the communication object, a directional pattern of an antenna must be changed.

Conventional art controls the direction of a main beam by changing a phase difference between array radiation elements, or changes a directional pattern using mechanical rotation.

However, according to the conventional art in which the phase difference between array radiation elements is changed, a plurality of additional circuits may be needed to control the phase of each array radiation element, the angle of pattern variation is a small angle, and a high side lobe occurs, resulting in a reduction of radiation efficiency of each antenna.

In addition, according to the conventional art in which the directional pattern changed using mechanical rotation, a separate structure for rotating the antenna is needed. If the communication object moves at high speed, it may be difficult for the directional pattern to be changed in the accurate direction.

SUMMARY

Therefore, it is an aspect of the present disclosure to provide an antenna apparatus configured to adjust a directional pattern toward a desired direction through simple switching without using a complicated feed structure of an array antenna, a vehicle including the antenna apparatus, and a method for controlling the antenna apparatus.

It is another aspect of the present disclosure to provide an antenna apparatus including not only an omni-directional antenna supporting seamless communication but also a directional antenna capable of selecting the direction of a beam pattern so as to perform efficient communication, a vehicle including the antenna apparatus, and a method for controlling the antenna apparatus.

Additional aspects of the disclosure will be set forth in part in the description which follows and, in part, will be obvious from the description, or may be learned by practice of the disclosure.

In accordance with an aspect of the present disclosure, aAn antenna apparatus includes: an omni-directional antenna configured to omni-directionally transmit or receive a signal; and a directional antenna module including a plurality of directional antennae having different radiation angles, wherein each of the directional antennae includes a feed unit to provide a signal; at least one waveguide through which the provided signal is propagated; and at least one radiation slot designed to radiate the signal propagated through the waveguide.

The plurality of directional antennae may be configured to receive electricity, independently of each other.

The antenna apparatus may further include: an antenna selection switch configured to selectively provide electricity to at least one of the plurality of directional antennae.

The antenna apparatus may further include: a controller configured to determine a directional antenna corresponding to the position of a communication object from among the plurality of directional antennae.

The controller may transmit a control signal to the antenna selection switch in such a manner that electricity is supplied to the directional antenna corresponding to the position of the communication object.

The omni-directional antenna may be always ready to receive a signal from the communication object.

The controller may determine the position of the communication object on the basis of positional information contained in the signal received by the omni-directional antenna.

The position information may include global positioning system (GPS) information.

The controller may determine the position of the communication object whenever the controller receives a signal from the communication object.

The controller may switch on the plurality of directional antennae when the omni-directional antenna receives the signal.

The controller may determine the position of the communication object on the basis of the directional antenna having received the signal from among the plurality of directional antennae.

The controller may switch off the directional antenna that has received no signal.

The controller may determine whether the position of the communication object is changed on the basis of an intensity of a signal received by the switched-on directional antenna, and switches on the plurality of directional antennae when the position of the communication object is changed.

The controller may determine whether the position of the communication object is changed on the basis of a signal received by the directional antenna, and switch on another directional antenna adjacent to the directional antenna having received the signal when the position of the communication object is changed.

If a distance to the communication object is a short distance equal to or less than a reference distance, the controller may control the antenna selection switch to communicate with the communication object using the omni-directional antenna.

The directional antenna module may include: a top plate; a bottom plate; and a plurality of barriers disposed between the top plate and the bottom plate so as to form a plurality of waveguides.

The plurality of waveguides may be classified into a plurality of groups, and the plurality of groups corresponds to the plurality of directional antennae.

The antenna apparatus may further include: a common ground unit located below the directional antenna module, wherein the feed unit contained in the plurality of directional antennae is connected to the common ground unit.

In accordance with another aspect of the present disclosure, a vehicle includes: an omni-directional antenna configured to omni-directionally transmit or receive a signal; and a directional antenna module including a plurality of directional antennae having different radiation angles, wherein each of the directional antennae includes a feed unit to provide a signal; at least one waveguide through which the provided signal is propagated; and at least one radiation slot designed to radiate the signal propagated through the waveguide.

The vehicle may further include: an antenna selection switch configured to selectively provide electricity to at least one of the plurality of directional antennae.

The vehicle may further include: a controller configured to determine a directional antenna corresponding to the position of a communication object from among the plurality of directional antennae, and transmit a control signal to the antenna selection switch in such a manner that electricity is supplied to the directional antenna corresponding to the position of the communication object.

The omni-directional antenna may be always ready to receive a signal from the communication object.

The controller may determine the position of the communication object on the basis of positional information contained in the signal received by the omni-directional antenna.

The controller may switch on the plurality of directional antennae when the omni-directional antenna receives the signal.

The controller may determine the position of the communication object on the basis of the directional antenna that has received the signal from among the plurality of directional antennae.

The controller may switch off the directional antenna that has received no signal.

The controller may determine whether the position of the communication object is changed on the basis of an intensity of the signal received by the directional antenna, and switch on the plurality of directional antennae when the position of the communication object is changed.

In accordance with another aspect of the present disclosure, a method for controlling an antenna apparatus includes: receiving, by an omni-directional antenna staying in a standby mode, a signal from a communication object; if the omni-directional antenna receives the signal, determining a directional antenna corresponding to a position of the communication object from among a plurality of directional antennae; and communicating with the communication object by switching on the determined directional antenna.

The step for determining the directional antenna corresponding to the position of the communication object may include: using positional information of the communication object contained in the received signal.

The method may further include: determining the position of the communication object when receiving the signal from the communication object.

The method may further include: if the position of the communication object is changed, switching on a directional antenna corresponding to the changed position from among the plurality of directional antennae.

The step for determining the directional antenna corresponding to the position of the communication object may include: switching on the plurality of directional antennae; and determining a directional antenna having received the signal from among the plurality of directional antennae to be a directional antenna corresponding to the position of the communication object.

The method may further include: switching off a directional antenna that has received no signal from among the plurality of directional antennae.

The method may further include: determining whether the position of the communication object is changed on the basis of intensity of the signal received by the switched-on directional antenna; and if the position of the communication object is changed, switching on the plurality of directional antennae.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
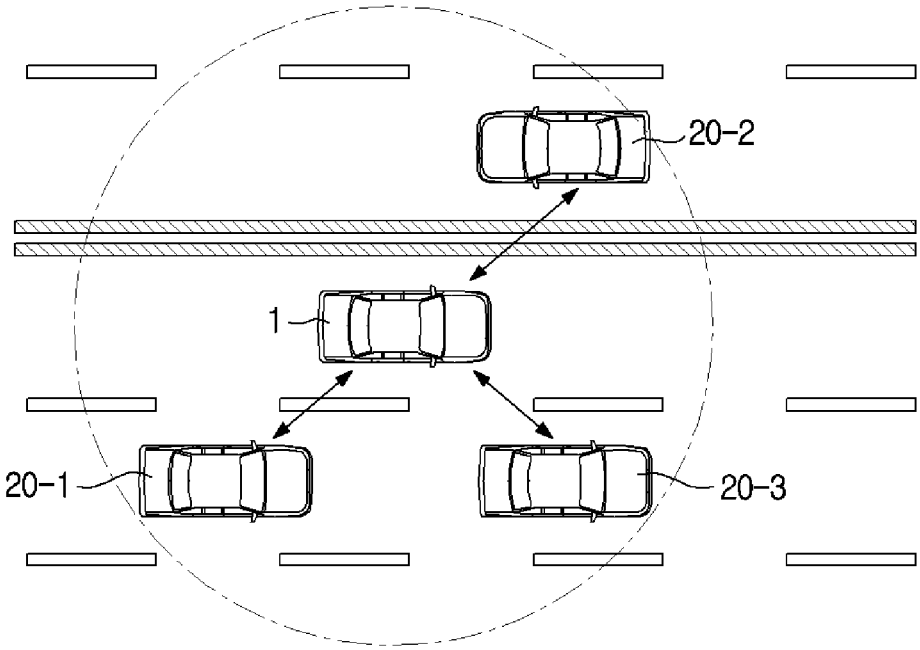
FIG. 1 is a conceptual diagram illustrating communication between a plurality of vehicles.

Reference will now be made in detail to the embodiments of the present disclosure, examples of which are illustrated in the accompanying drawings, wherein like reference numerals refer to like elements throughout.

Figure 2:
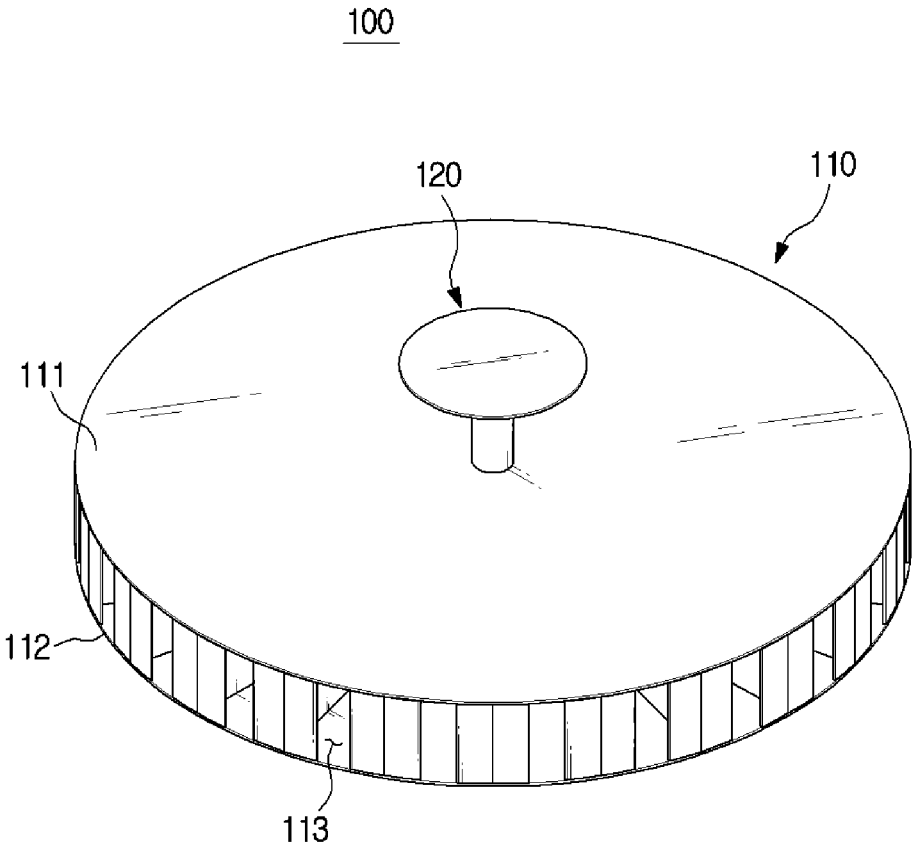
FIGS. 2 and 3 are perspective views illustrating an antenna apparatus according to an embodiment of the present disclosure.
Figure 3:
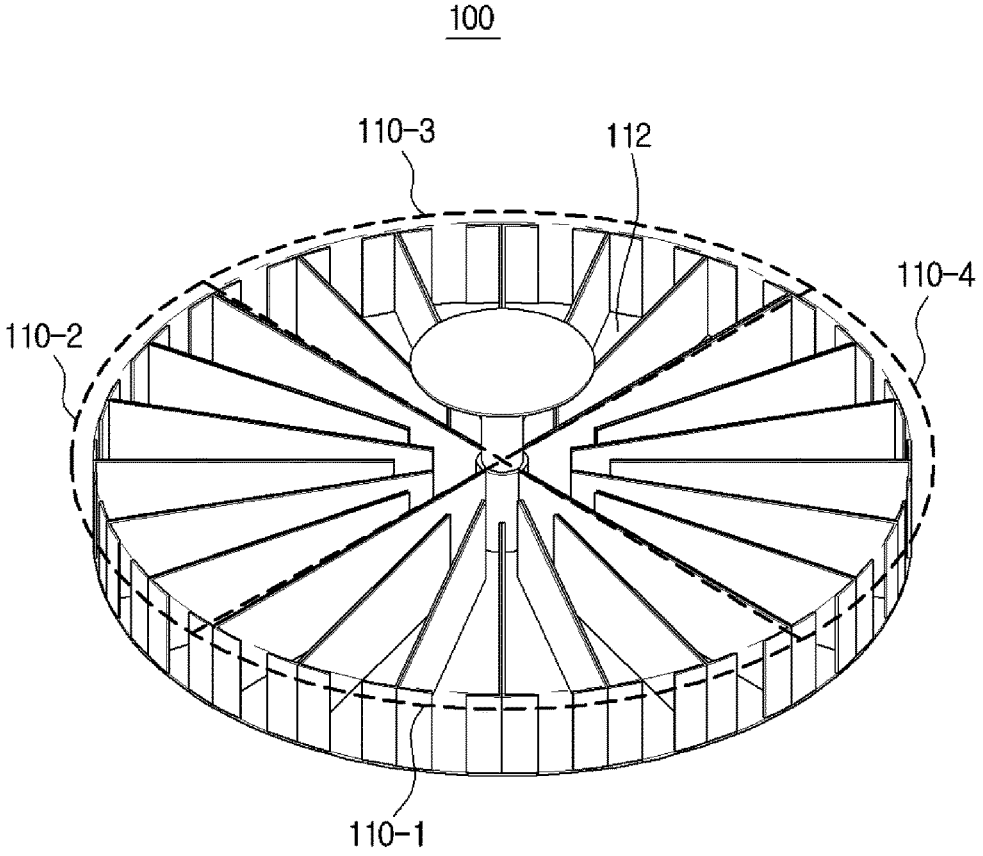

FIG. 1 is a conceptual diagram illustrating communication between a plurality of vehicles. FIGS. 2 and 3 are perspective views illustrating an antenna apparatus according to an embodiment of the present disclosure.

Referring to FIG. 1, if a communication module including one or more antennae is mounted to a vehicle 1, the vehicle 1 including the communication module may communicate with peripheral vehicles (20-1, 20-2, 20-3) such that necessary signals can be communicated between the vehicle 1 and the peripheral vehicles (20-1, 20-2, 20-3).

During Vehicle to Vehicle (V2V) communication, the vehicle 1 may directly communicate with peripheral vehicles (20-1, 20-2, 20-3) without passing through a base station (BS). In order to perform V2V communication, relative positions of the vehicle 1 and the peripheral vehicles must be recognized and a beam pattern for the corresponding position must be formed.

However, since the position relationship between the vehicle 1 and the peripheral vehicles (20-1, 20-2, 20-3) is variable, it may be difficult to determine the position of each peripheral vehicle corresponding to the communication object, and the beam pattern of each antenna must be changed in real-time to reflect the relative positional relationship between the vehicle 1 and the peripheral vehicles (20-1, 20-2, 20-3).

In order to reflect the above-mentioned requirements, the antenna apparatus 100 may include a directional antenna module 110 to selectively change the direction of a beam pattern, and an omni-directional antenna module 120 to receive signals in a standby mode, as shown in FIG. 2.

The directional antenna module 110 may include a top plate 111, a bottom plate 112 disposed over the top plate 111, and a plurality of barriers 114 (See FIG. 4) to divide a cavity (or space) between the top plate 111 and the bottom plate 112 into a plurality of sub-cavities. Radio frequency (RF) signals (i.e., propagation signals) may be emitted to the outside through a plurality of radiation slots 113 formed by the top plate 111, the bottom plate 112, and the barriers 114.

FIG. 3 is a perspective view illustrating the antenna apparatus from which the top plate 111 is omitted to illustrate the internal structure of the directional antenna module 110.

The directional antenna module 110 may be classified into a plurality of groups so as to selectively form the directional beam pattern. As can be seen from FIG. 3, the directional antenna module 110 may be classified into four groups, i.e., a first directional antenna 110-1, a second directional antenna 110-2, a third directional antenna 110-3, and a fourth directional antenna 110-4.

Individual groups may have different radiation angles, such that the beam pattern may be formed in different directions, and an appropriate directional antenna can be selected according to the position of a communication object so that the respective groups can communicate with each other. In this embodiment, the radiation angle may denote coverage on an x-y plane, and a reference of the radiation angle may be considered relative.

In accordance with the example of FIG. 3, respective directional antennae (110-1, 110-2, 110-3, 110-4) may have a radiation range of 90 degrees (90°). For example, the first directional antenna 110-1 may have radiation angles of 0~90°, the second directional antenna 110-2 may have radiation angles of 90~180°, the third directional antenna 110-3 may have radiation angles of 180~270°, and the fourth directional antenna 110-4 may have radiation angles of 270~360°.

Therefore, the directional antenna module 110 may cover all directions (omni-direction) in 360°.

Since respective directional antennae may be independently fed, the antenna corresponding to a signal transmission direction may be selected and fed, resulting in a formation of a desired directional beam pattern.

In addition, the radiation range of a uni-directional antenna, arrangement of antennae, and the number of antennae may be modified in various ways, such that coverage of the directional antenna module 110 can be adjusted.

Figure 4:
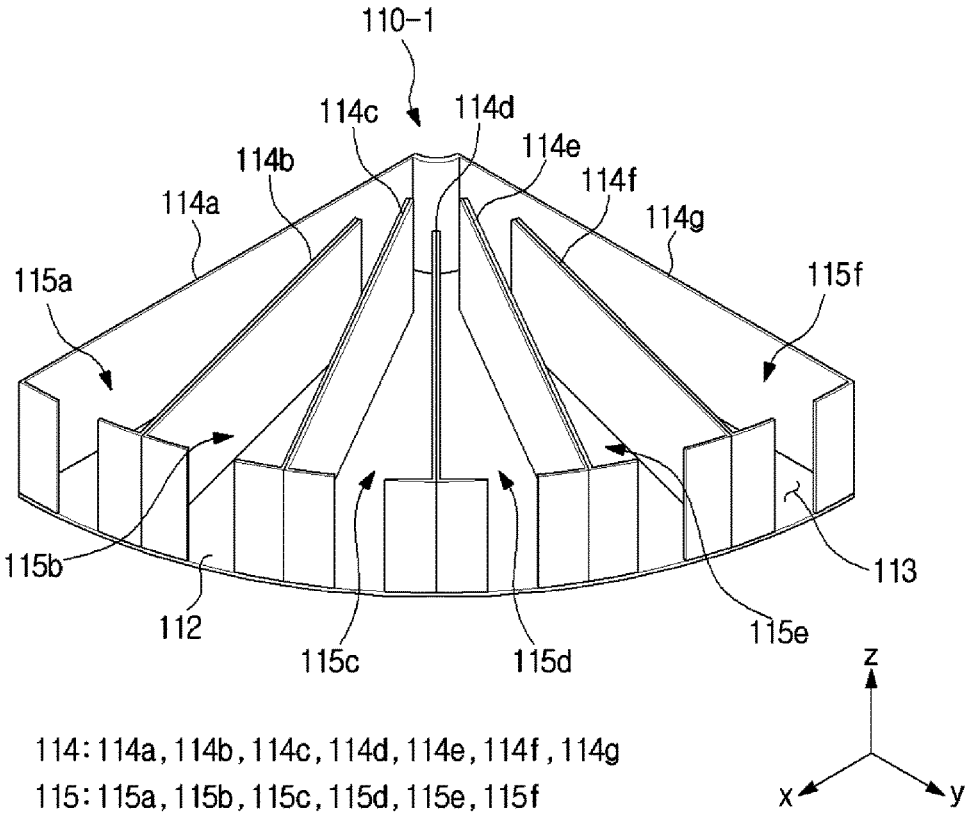
FIG. 4 is a perspective view illustrating a uni-directional antenna structure.
Figure 5:
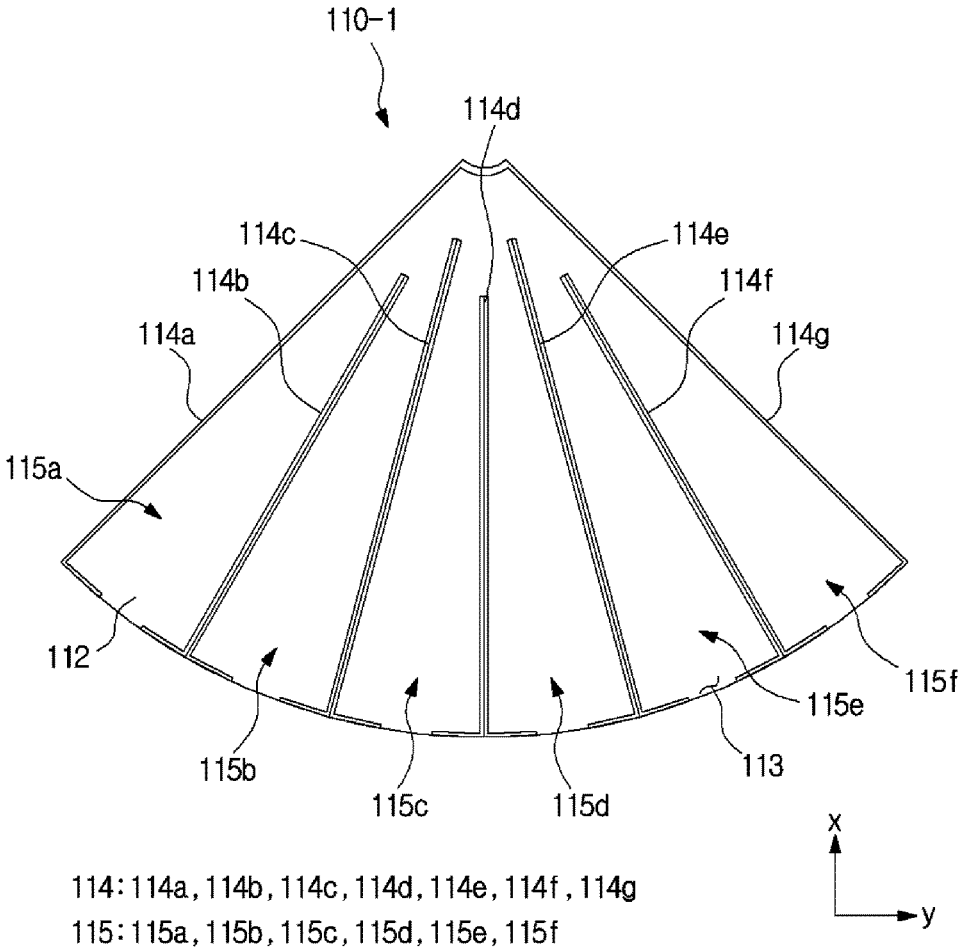
FIG. 5 is a plan view illustrating a uni-directional antenna structure.
Figure 6:
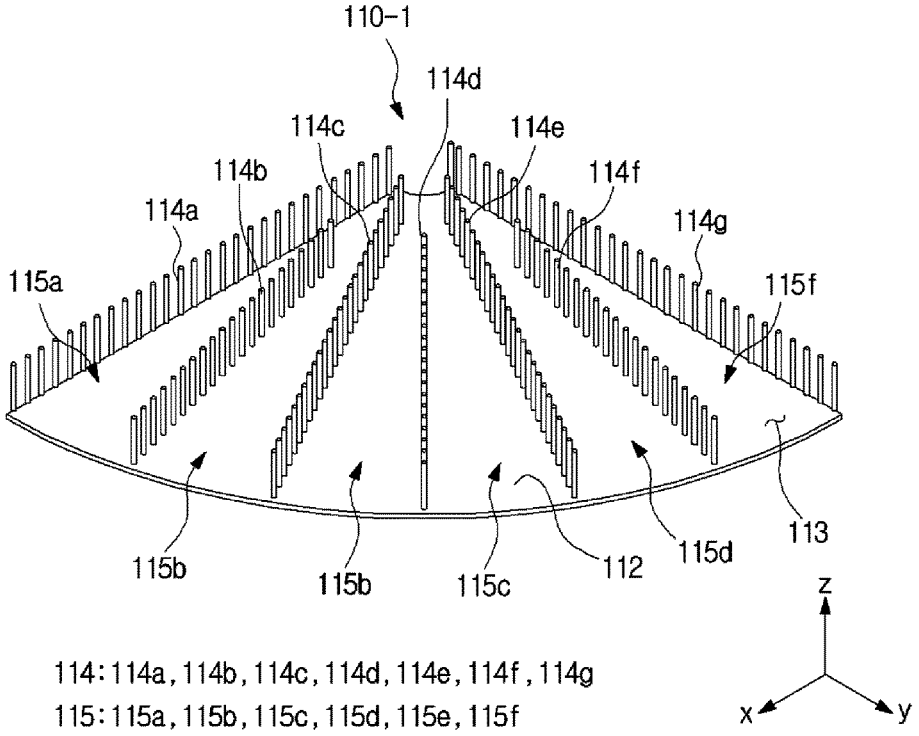
FIG. 6 is a perspective view illustrating another example of a uni-directional antenna structure.

FIG. 4 is a perspective view illustrating a uni-directional antenna structure. FIG. 5 is a plan view illustrating a uni-directional antenna structure. FIG. 6 is a perspective view illustrating another example of a uni-directional antenna structure.

FIGS. 4 to 6 illustrate a first directional antenna 110-1. The remaining directional antennae (i.e., the second directional antenna 110-2, the third directional antenna 110-3, and the fourth directional antenna 110-4) may have the same structure as the first directional antenna 110-1, and as such a detailed description thereof will herein be omitted for convenience of description.

As can be seen from FIGS. 4 to 6, each directional antenna may have a fan shape on the x-y plane, and a directional antenna module 110 including the directional antennae (110-1, 110-2, 110-3, 110-4) arranged on the same plane may have a circular shape on the x-y plane. However, the above examples are disclosed only for illustrative purposes, and each antenna may have not only a fan shape but also other shapes such as a polygonal shape.

In addition, the directional antenna module 110 may have not only the shapes of plural directional antennae (110-1, 110-2, 110-3, 110-4) but also other shapes (e.g., a polygonal shape, a semicircular shape, etc.) according to the number of directional antennae.

For convenience of description and better understanding of the present disclosure, the following embodiment will exemplarily disclose that the antenna has a fan shape and the directional antenna module 110 has a circular shape.

Referring to FIGS. 4 and 5, waveguides 115 (115*a*, 115*b*, 115*c*, 115*d*, 115*e*, 115*f*) may be formed by barriers 114 (114*a*, 114*b*, 114*c*, 114*d*, 114*e*, 114*f*, 114*g*) configured to divide the cavity between the top plate 111 and the bottom plate 112 into a plurality of sub-cavities.

For example, if 6 waveguides are formed in the first directional antenna 110-1, the barriers 114 configured to divide the waveguides 115 (115*a*, 115*b*, 115*c*, 115*d*, 115*e*, 115*f*) may be comprised of 7 barriers corresponding to the first to seventh barriers (114*a*, 114*b*, 114*c*, 114*d*, 114*e*, 114*f*, 114*g*).

The first waveguide 115*a* may be formed by the first barrier 114*a* and the second barrier 114*b*, the second waveguide 115*b* may be formed by the second barrier 114*b* and the third barrier 114*c*, and the third waveguide 115*c* may be formed by the third barrier 114*c* and the fourth barrier 114*d*. In addition, the fourth waveguide 115*d* may be formed by the fourth waveguide 114*d* and the fifth waveguide 115*e*, and the fifth waveguide 115*e* may be formed by the fifth barrier 114*e* and the sixth barrier 114*f*, and the sixth waveguide 115*f* may be formed by the sixth barrier 114*f* and the seventh barrier 114*g*.

In addition, the first directional antenna 110-1 may border the first directional 110-3 and the fourth directional antenna 110-4 horizontally adjacent to each other, and may also share the seventh barrier 114*g* and the first barrier 114*a*.

The top plate 111, the bottom plate 112, and the barrier 114 may be formed of a conductive material such as a metal, for example, copper (Cu), aluminum (Al), lead (Pb), silver (Ag), stainless steel, etc. In this case, the first directional antenna 110-1 may be formed by 3D printing, casting, etc.

Alternatively, the barriers 114, each of which is formed in a plate shape, may be arranged between the top plate 111 and the bottom plate 112, each of which may be implemented as a printed circuit board (PCB), such that the first directional antenna 110-1 may also be formed.

In addition, a cavity between the top plate 111 and the bottom plate 112 may be filled with a dielectric material. The dielectric material may include air. The waveguide 115 formed by a conductor may propagate one or more RF signals (propagation signals), and the RF signals propagated through the waveguide 115 may emit to the outside through the radiation slot 113.

Referring to FIG. 6, the barriers 114 may also be implemented as a plurality of fins arranged at intervals of a predetermined distance. The distance between neighboring fins (adjacent fins) may be limited to a threshold distance or less, such that the loss of an RF signal passing through the waveguide 115 can be prevented. For example, the plurality of fins may be arranged at intervals of a predetermined distance corresponding to 1/10 (or less) of a wavelength of the RF signal so as to prevent the occurrence of lost RF signals.

The first directional antenna 110-1 shown in FIG. 6 may implement each of the top plate 111 and the bottom plate 112 as the PCB, and the barriers 114 may be implemented by inserting the plurality of metal fins into the top plate 111 and the bottom plate 112. In this case, fabrication and design can be facilitated.

In this case, the cavity between the top plate 111 and the bottom plate 112 may be filled with a dielectric material, and the dielectric material may include the air therein.

The antenna structures shown in FIGS. 4 to 6 may also be applied to the first directional antenna 110-1, the second directional antenna 110-2, the third directional antenna 110-3, and the fourth directional antenna 110-4 without departing from the scope or spirit of the present disclosure.

In addition, the directional antennae (110-1, 110-2, 110-3, 110-4) may share the top plate 111 and the bottom plate 112. For example, if the directional antennae (110-1, 110-2, 110-3, 110-4) may be implemented as shown in FIGS. 4 to 5, the entire shape of the antenna module 110 may be fabricated by 3D printing or casting, the waveguide 115 may be grouped, and the feed structure for each group may be independently provided, such that the plurality of directional antennae (110-1, 110-2, 110-3, 110-4) can be implemented.

If the directional antennae (110-1, 110-2, 110-3, 110-4) are implemented as shown in FIG. 6, a circular PCB substrate may be used as the top plate 111 and the bottom plate 112, and metal fins may be inserted into the upper plate 111 and the bottom plate 112, such that a plurality of waveguides 115 may be formed. In this way, the waveguide 115 is grouped, and an independent feed structure for each group is provided, such that a plurality of directional antennae (110-1, 110-2, 110-3, 110-4) can be formed.

However, the above-mentioned embodiment is merely an example applicable to the antenna apparatus 100, and a method for fabricating the antenna apparatus 100 is not limited thereto.

Figure 7:
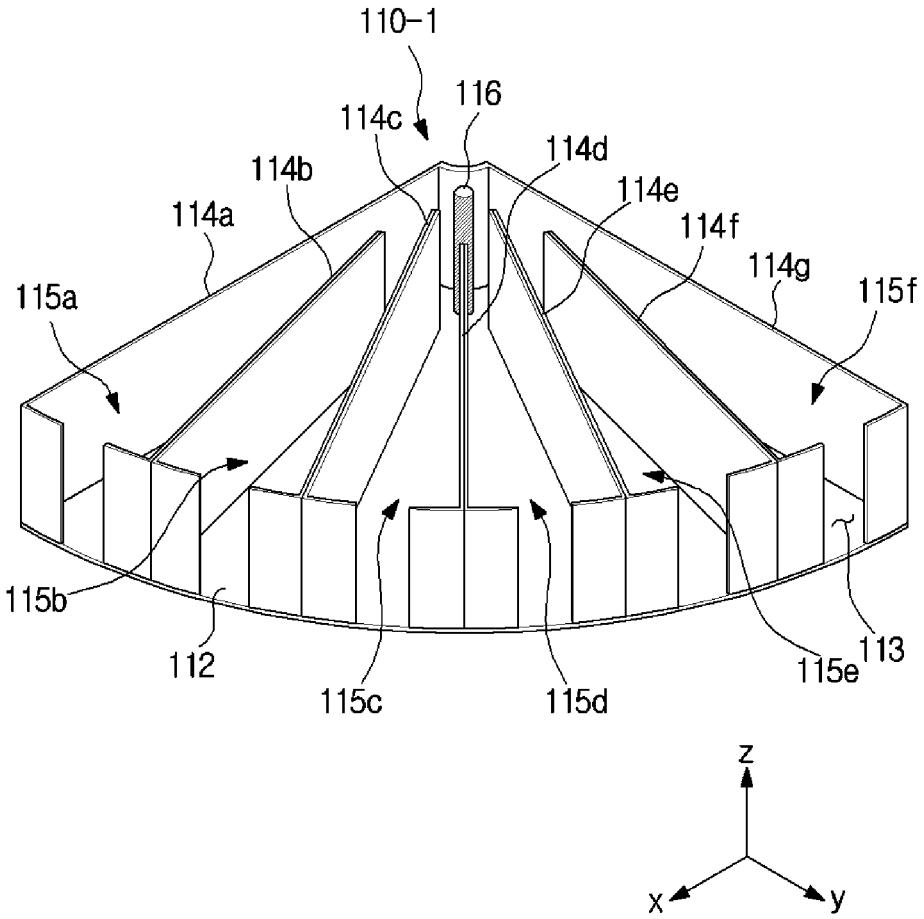
FIG. 7 is a schematic diagram illustrating a feed structure of a uni-directional antenna contained in a directional antenna module.
Figure 8:
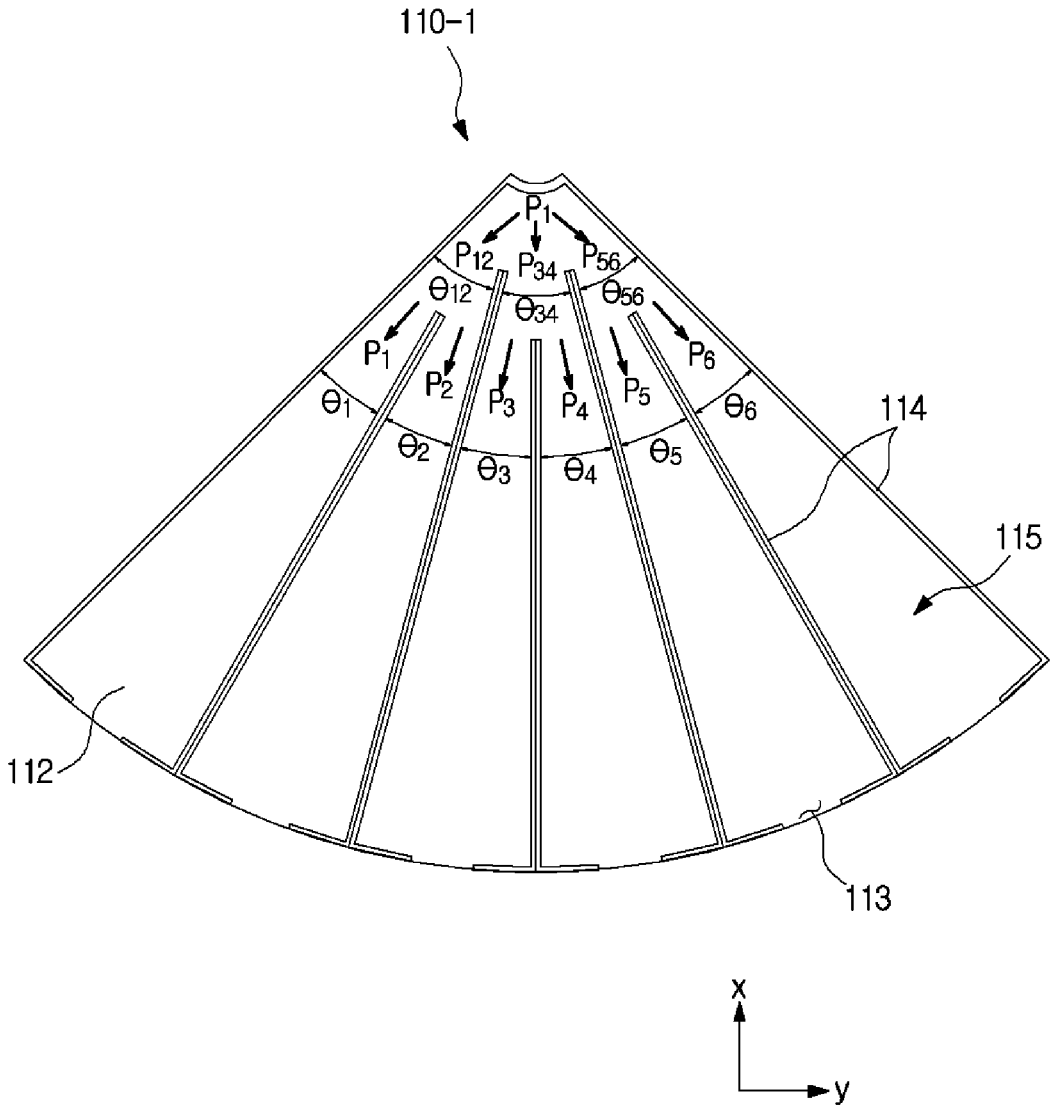
FIG. 8 is a conceptual diagram illustrating a distribution of power supplied through a feed unit.

FIG. 7 is a schematic diagram illustrating a feed structure of a uni-directional antenna contained in a directional antenna module. FIG. 8 is a conceptual diagram illustrating a distribution of power supplied through a feed unit.

Referring to FIG. 7, a feed unit 116 may be connected to the opposite side of the radiation slot 113 (i.e., the center point of the fan shape). For example, the feed unit 116 may be implemented in a fin shape, and the feed fin may receive signals through an antenna selection switch formed over a ground substrate.

The feed unit 116 may be independently provided for each uni-directional antenna. Therefore, the feed unit 116 may also be mounted to the second directional antenna 110-2, the third directional antenna 110-3, and the fourth directional antenna 110-4.

The RF signal received from the feed unit 116 may be branched into 6 waveguides (115*a*, 115*b*, 115*c*, 115*d*, 115*e*, 115*f*), and the branched RF signals may be propagated through the waveguide 115. The RF signal may be emitted to the external space through the radiation slots (113*a*, 113*b*, 113*c*, 113*d*, 113*e*, 113*f*) formed in the end of each waveguide.

Meanwhile, when the RF signal received from the feed unit 116 is branched into a plurality of signals, power of the RF signal is distributed. In the above-mentioned example, the barrier structure 114 may serve as a power distribution unit. A method for branching, or distributing, the RF signal will hereinafter be given with reference to FIG. 8, from the viewpoint of power distribution.

Referring to FIG. 8, the length of the barrier 114 forming each waveguide may be adjusted, such that power received from the feed unit 116 can be distributed stepwise.

For example, as can be seen from FIG. 8, the length of the second barrier 114*b* acting as a boundary between the first waveguide 115*a* and the second waveguide 115*b*, the length of the fourth barrier 114*d* acting a boundary between the third waveguide 115*c* and the fourth waveguide 115*d*, and the length of the sixth barrier 114*f* acting as a boundary between the fifth waveguide 115*e* and the sixth waveguide 115*f* may be implemented to be shorter than the length of the remaining barriers. The length of the barrier may be in the range from the end of a barrier adjacent to the feed unit 116 to the end of the opposite side. If the uni-directional antenna is formed in a fan shape, this may imply the length of a diameter.

Since the first barrier 114*a* and the seventh barrier 114*g* are used as a boundary of other neighbor antennae, the first barrier 114*a* and the seventh barrier 114*g* may extend to the rear end of the feed unit 116. The forward direction of the feed unit 116 may be a distribution direction of power or the RF signal, and the backward direction of the feed unit 116 may be directed to the center of the antenna formed in a fan shape. The third barrier 114*c* and the fifth barrier 114*e* may be longer than the second barrier 114*b*, the fourth barrier 114*d*, and the sixth barrier 114*f*, and may be shorter than the first barrier 114*a* and the seventh barrier 114*g*.

If the first directional antenna 110-1 includes the above-mentioned barriers, power P1 supplied from the feed unit 116 may be distributed to a first cavity between the first barrier 114*a* and the third barrier 114*c*, a second cavity between the third barrier 114*c* and the fifth barrier 114*e*, and a third cavity between the fifth barrier 114*e* and the seventh barrier 114*g*. In this case, power distributed to the first cavity is denoted by $P_{12}$, power distributed to the second cavity is denoted by $P_{34}$, and power distributed to the third cavity is denoted by $P_{56}$.

In order to allow the distributed powers ($P_{12}$, $P_{34}$, $P_{56}$) to have the same value, the angle ($\theta_{12}$) between the first barrier 114*a* and the third barrier 114*c*, the angle ($\theta_{34}$) between the third barrier 114*c* and the fifth barrier 114*e*, and the angle ($\theta_{56}$) between the fifth barrier 114*e* and the seventh barrier 114*g* may be identical to each other.

In other words, $\theta_{12}=\theta_{34}=\theta_{56}$ must be established to achieve $P_{12}=P_{34}=P_{56}$. In addition, since the supplied power ($P_1$) is distributed to three equal powers, the relationship of $P_1=3P_{12}=3P_{34}=3P_{56}$ is achieved.

Power $P_{12}$ distributed to the cavity between the first barrier 114*a* and the third barrier 114*c* may be re-distributed to the cavity between the first barrier 114*a* and the second barrier 114*b* and the cavity between the second barrier 114*b* and the third barrier 114*c*. That is, the power $P_{12}$ may be distributed to the first waveguide 115*a* and the second waveguide 115*b*. In this case, power distributed to the first waveguide 115*a* and power distributed to the second waveguide 115*b* may be $P_1$ and $P_2$, respectively.

Power $P_{34}$ distributed to the cavity between the third barrier 114*c* and the fifth barrier 114*e* may be re-distributed to the cavity between the third barrier 114*c* and the fourth barrier 114*d* and the cavity between the fourth barrier 114*d* and the fifth barrier 114*e*. In other words, power $P_{34}$ may be distributed to the third waveguide 115*c* and the fourth waveguide 115*d*. In this case, power distributed to the third waveguide 115*c* and power distributed to the fourth waveguide 115*d* may be $P_3$ and $P_4$, respectively.

Power $P_{56}$ distributed to the cavity between the fifth barrier 114*e* and the seventh barrier 114*g* may be re-distributed to the cavity between the fifth barrier 114*e* and the sixth barrier 114*f* and the cavity between the sixth barrier 114*f* and the seventh barrier 114*g*. That is, power distributed to the fifth waveguide 115*e* and power distributed to the sixth waveguide 115*f* may be $P_5$ and $P_6$, respectively.

In order to allow powers distributed to respective waveguides to have the same value, the angle ($\theta_1$) between the first barrier 114*a* and the second barrier 114*b*, the angle ($\theta_2$) between the second barrier 114*b* and the third barrier 114*c*, the angle ($\theta_3$) between the third barrier 114*c* and the fourth barrier 114*d*, the angle ($\theta_4$) between the fifth barrier 114*d* and the fifth barrier 114*e*, the angle ($\theta_5$) between the fifth barrier 114*e* and the sixth barrier 114*f*, and the angle ($\theta_6$) between the sixth barrier 114*f* and the seventh barrier 114*g* may be designed to be identical to each other. In other words, the relationship of $\theta_{12}=2\theta_1=2\theta_2$ may be established, the relationship of $\theta_{34}=2\theta_3=2\theta_4$ may be established, and the relationship of $\theta_{56}=2\theta_5=2\theta_6$ may then be established.

Thus, the relationship of $P_1=3P_{12}=3P_{34}=3P_{56}=6P_1=6P_2=6P_3=6P4=6P5=6P6$ may be achieved. That is, the same-magnitude power may be distributed to respective waveguides, and the RF signals having the same phase and the same amplitude may be distributed, such that the resultant signals can be emitted through the radiation slot.

As can be seen from the above example, if the directional antenna module 110 is composed of four antennae (110-1, 110-2, 110-3, 110-4), $\theta_{12}=\theta_{34}=\theta_{56}=30°$ may be achieved, or $\theta_1=\theta_2=\theta_3=\theta_4=\theta_5=\theta_6=15°$ may be achieved.

Meanwhile, the operation for performing power distribution using the above-mentioned barrier structure is merely an example applicable to the antenna apparatus 100, and various modifications may be established. For example, the power distribution step may be fragmented into sub-steps or may be simultaneously distributed to 6 directions, or the number of waveguides may be lower or higher than 6, without departing from the scope or spirit of the present disclosure.

Figure 9:
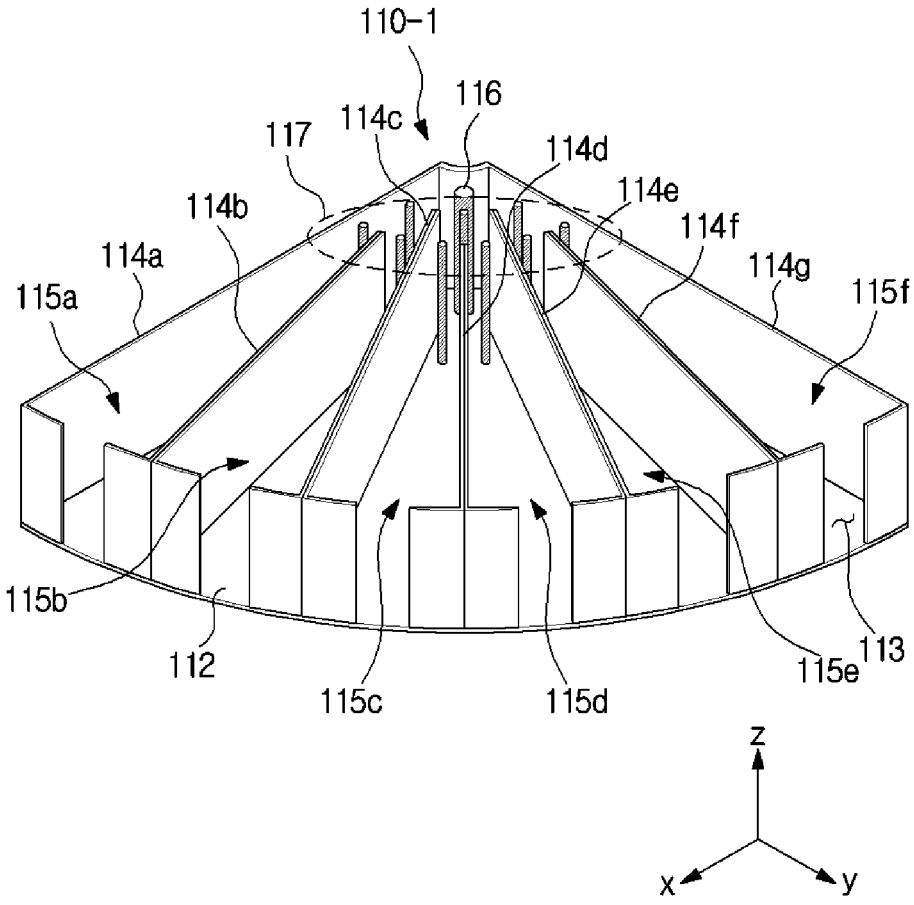
FIGS. 9 and 10 are schematic diagrams illustrating a feed structure further including an inductive post.
Figure 10:
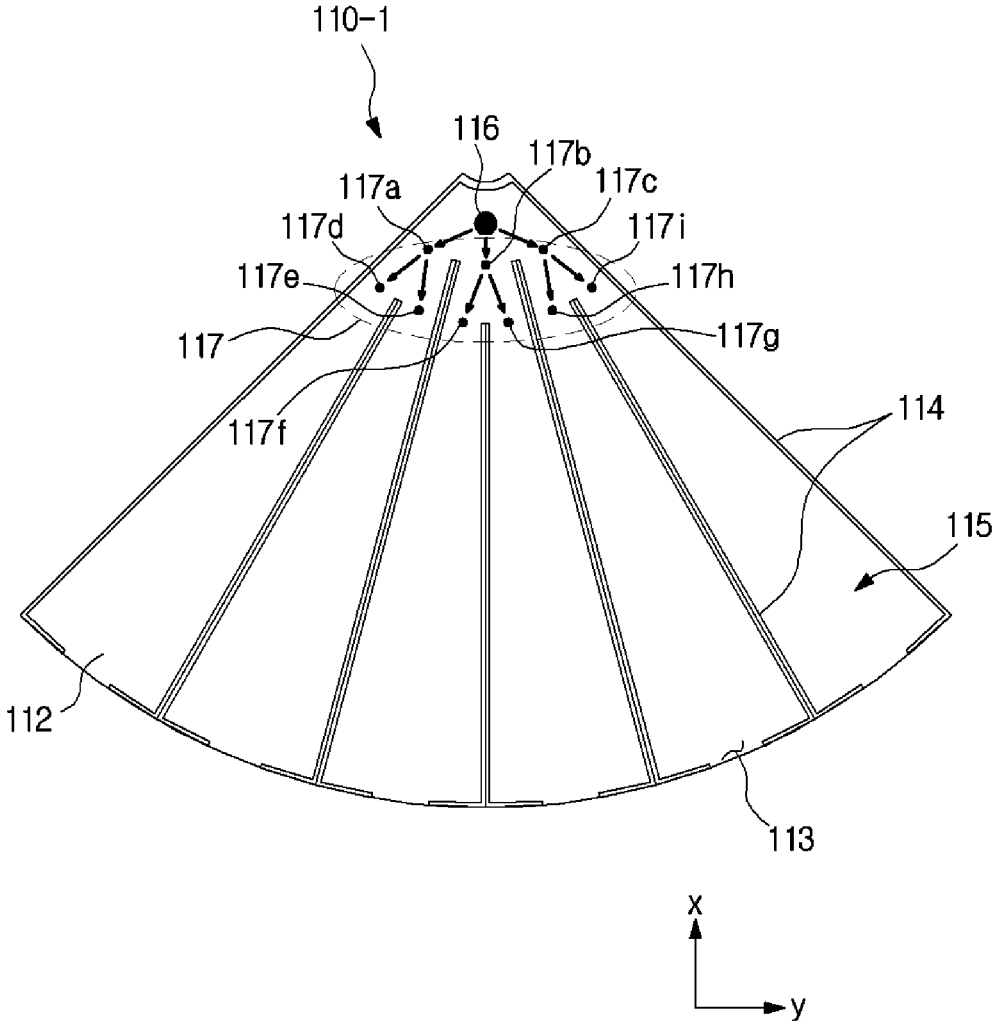

FIGS. 9 and 10 are schematic diagrams illustrating a feed structure further including an inductive post.

Referring to FIGS. 9 and 10, an inductive post 117 may be further contained in the first directional antenna 110-1 so as to improve the return loss (i.e., reflection loss). The inductive post may be formed of a metal fin.

Assuming that power distribution is achieved as described above, three inductive posts (117*a*, 117*b*, 117*c*) may be first arranged to the position located close to the feed unit 116, and 6 inductive posts (117*d*, 117*e*, 117*f*, 117*g*, 117*h*, 117*i*) corresponding to respective waveguides may be arranged behind the three inductive posts.

In more detail, the inductive posts (117*a*, 117*b*, 117*c*) may be respectively arranged in the cavity between the first barrier 114*a* and the third barrier 114*c*, the cavity between the third barrier 114*c* and the fifth barrier 114*e*, and the cavity between the fifth barrier 114*e* and the seventh barrier 114*g*.

In addition, the inductive posts (117*d*, 117*e*, 117*f*, 117*g*, 117*h*, 117*i*) may be respectively arranged in the cavity between the first barrier 114*a* and the second barrier 114*b*, the cavity between the second barrier 114*b* and the third barrier 114*c*, the cavity between the third cavity 114*c* and the fourth barrier 114*d*, the cavity between the fourth cavity 114*d* and the fifth barrier 114*e*, the cavity between the fifth barrier 114*e* and the sixth barrier 114*f*, and the cavity between the sixth barrier 114*f* and the seventh barrier 114*g*.

As described above, the inductive posts may be arranged as described, and the return loss of the RF signal distributed to respective cavities may be improved by about 20%.

The inductive post 117 may be connected to the top plate 111 and the bottom plate 112. Since there may be a difference in inductive capacitance according to the diameter of the inductive post 117, the diameter of the inductive post 117 may be determined in consideration of the return loss amount. In addition, the distance between the inductive post 117 and the feed unit 116 may be determined according to the intermediate frequency of the RF signal.

In addition, the height of the feed unit 116 may also affect the return loss, such that the feed unit 116 may be designed to have a height capable of minimizing the return loss amount. In this case, the height of the feed unit 116 capable of minimizing the return loss amount may be determined by simulation, experiment or calculation.

In addition, if the inductive post 117 is arranged as described, capacitance between the top plate 111 and the bottom plate 112 may be reduced such that impedance change occurs. As a result, the height of the feed unit 116 may be properly adjusted according to an arrangement of the inductive post 117.

Figure 11:
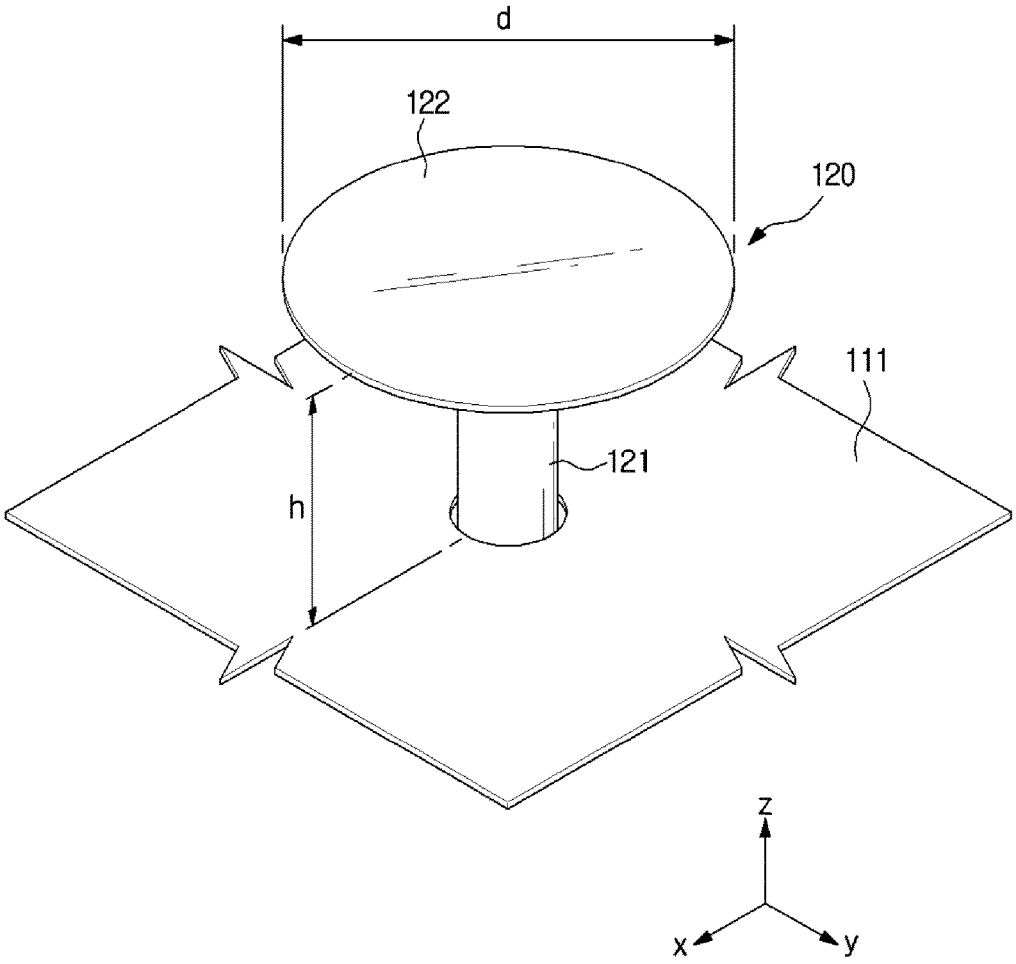
FIG. 11 is a schematic diagram illustrating an omni-directional antenna contained in the antenna apparatus according to an embodiment of the present disclosure.

FIG. 11 is a schematic diagram illustrating an omni-directional antenna contained in the antenna apparatus according to an embodiment of the present disclosure.

As described above, the antenna apparatus 100 according to the embodiment may include the directional antenna module 110 and the omni-directional antenna 120. The omni-directional antenna 120 may omni-directionally emit the RF signal.

For example, the omni-directional antenna 120 may include various kinds of antennae, for example, a dipole antenna, a monopole antenna, etc.

As can be seen from FIG. 11, the omni-directional antenna 120 may be implemented as a monopole antenna. The monopole antenna may be one kind of a conductive antenna composed of a conductive line formed of a conductor, and may further include a conductive line 121 having a predetermined length (h) corresponding to a ¼ wavelength of the RF signal, and a rod 122 disposed over the conductive line 121 to improve a gain of a horizontal plane (xy plane). The region of the rod 122 can also be determined on the basis of the intermediate frequency or the frequency band of the RF signal.

For example, if the frequency of the RF signal is in the frequency band of 60 GHz, the length (h) of the conductive line 121 may be set to 1.1 mm, and the diameter (d) of the circular rod 122 may be set to 1.3 mm. In addition, a total height of the antenna apparatus 100 may be set to 2.1 mm, and a radius of the antenna apparatus 100 may be set to 6 mm.

Figure 12:
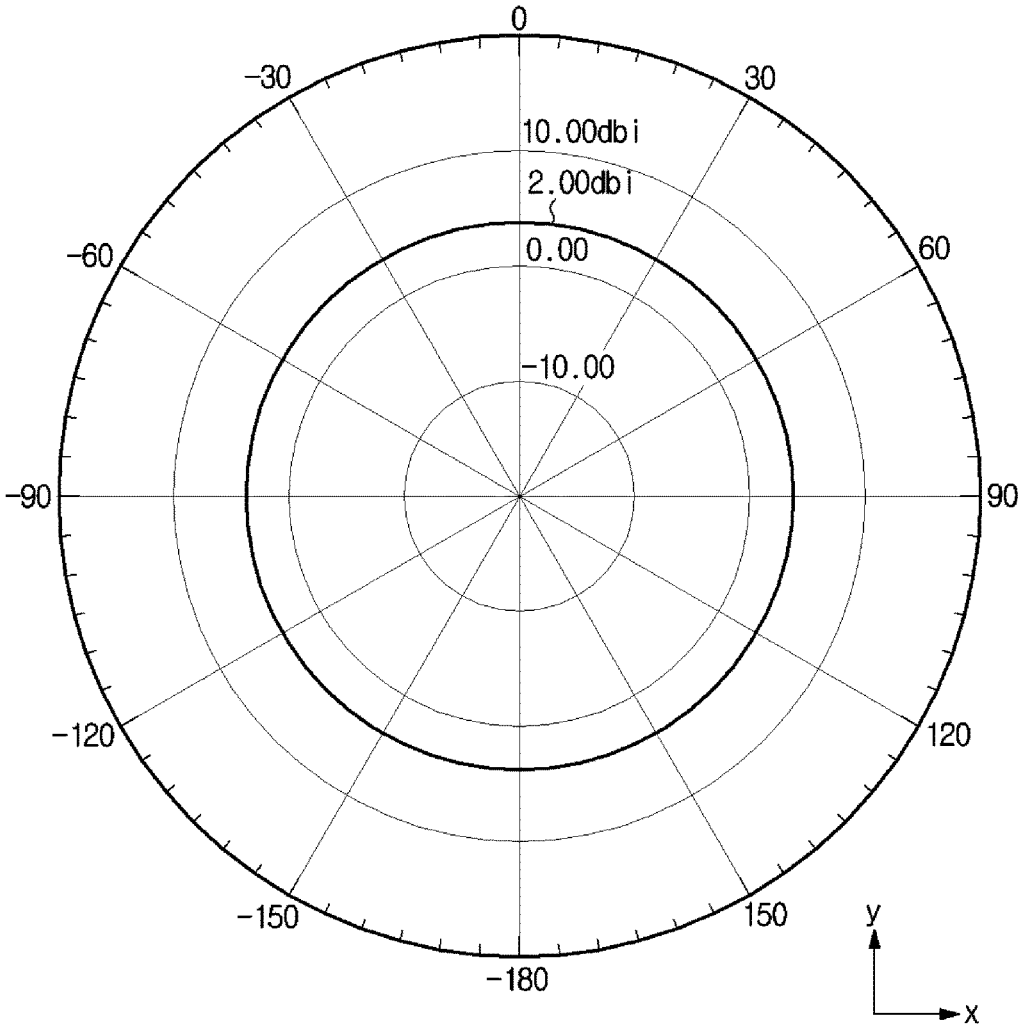
FIG. 12 is a conceptual diagram illustrating a radiation pattern of an omni-directional antenna.
Figure 13:
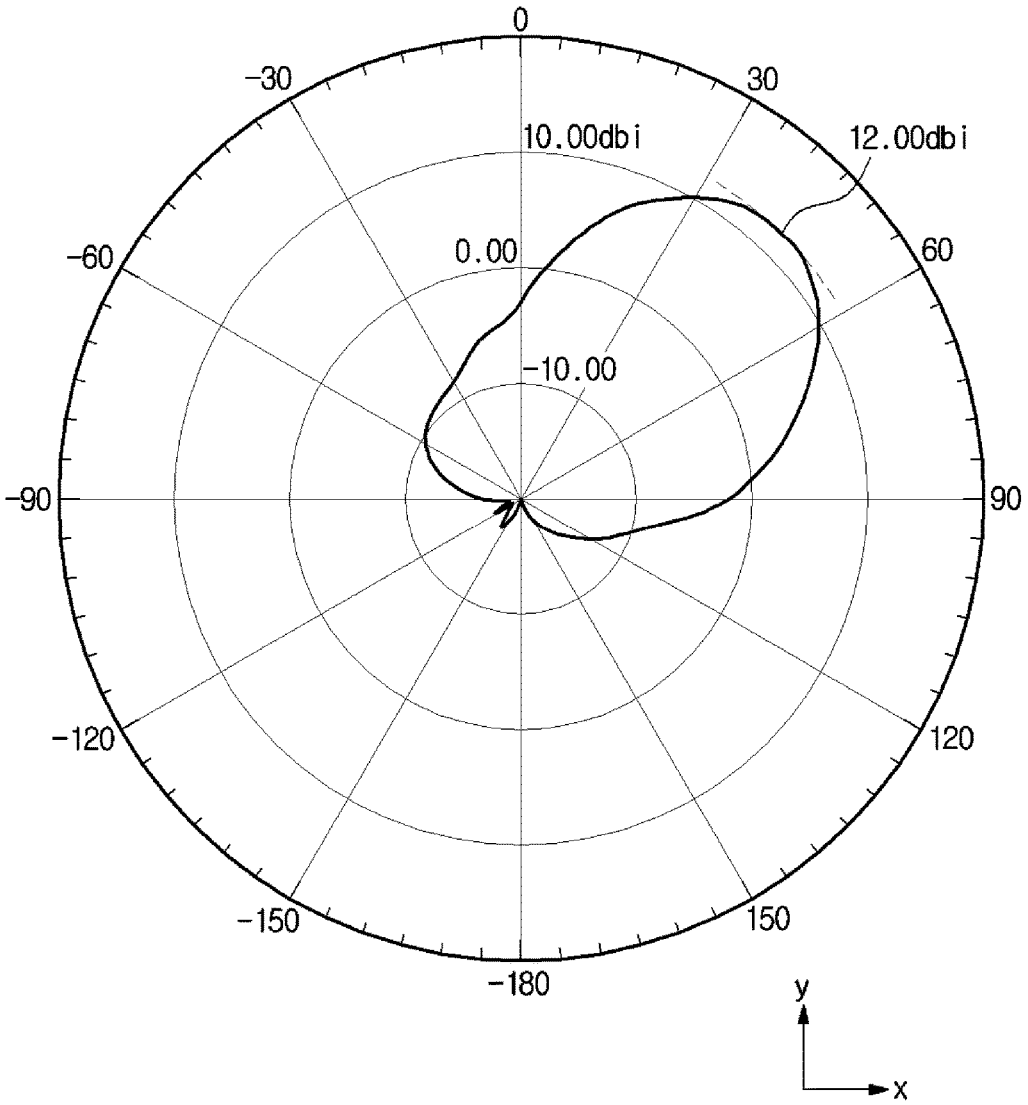
FIG. 13 is a conceptual diagram illustrating one radiation pattern from among a plurality of directional antennae contained in a directional antenna module.

FIG. 12 is a conceptual diagram illustrating a radiation pattern of an omni-directional antenna. FIG. 13 is a conceptual diagram illustrating one radiation pattern from among a plurality of directional antennae contained in an directional antenna module.

Referring to FIG. 12, the radiation pattern of the omni-directional antenna 120 may allow a 360° range of the horizontal plane (i.e., the xy plane) to be covered, and a gain of about 2 dBi may be measured.

Referring to FIG. 13, one radiation pattern from among a plurality of directional antennae contained in the directional antenna module 110 may have a coverage of about 90°. As a result, although the above radiation pattern has a smaller coverage as compared to the omni-directional antenna 120, a superior peak gain of about 12 dBi may be obtained.

In the directional antenna module 110, the coverage and the peak gain can be freely designed by adjusting the radiation range of the uni-directional antenna, the center angle, the number of slots, the number of branches of a power distribution unit, etc.

The omni-directional antenna 120 may always receive signals in a standby mode. If the omni-directional antenna 120 receives the signals, one of the plurality of directional antennae forming the directional antenna module 110 may be turned on such that the omni-directional antenna 120 can communicate with the selected directional antenna. The antenna switching operation will hereinafter be described with reference to FIG. 14.

Figure 14:
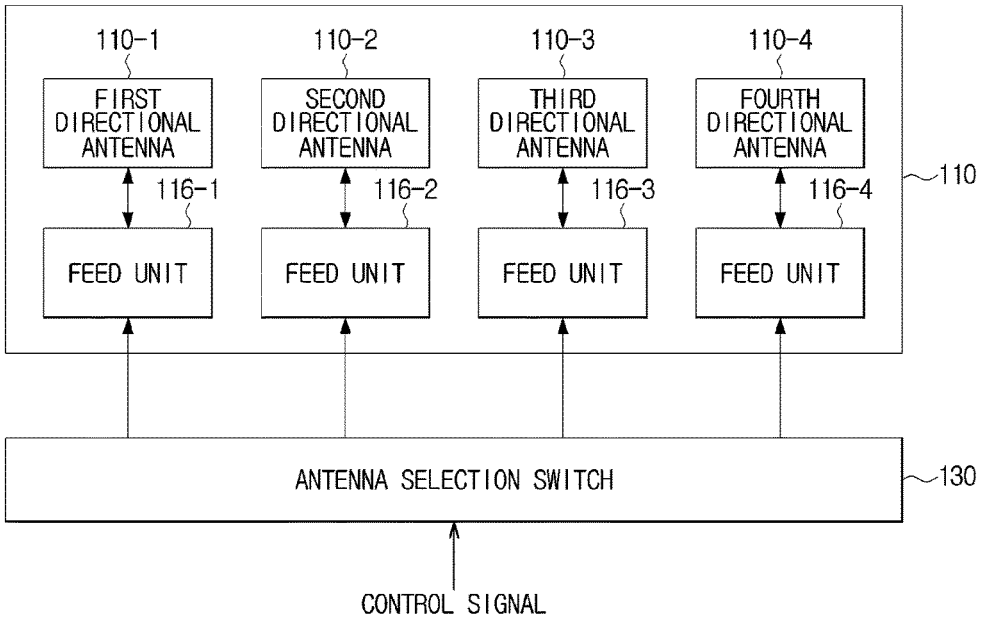
FIG. 14 is a block diagram illustrating a switch for selectively switching antennae contained in a directional antenna module.

FIG. 14 is a block diagram illustrating a switch for selectively switching antennae contained in the directional antenna module.

Referring to FIG. 14, the antenna apparatus 100 may further include an antenna selection switch 130 configured to selectively switch at least one of the directional antennae (110-1, 110-2, 110-3, 110-4) contained in the directional antenna module 110. For example, the antenna selection switch 130 may be implemented by a radio frequency (RF) switch.

The feed unit 116-1 for feeding electricity to the first directional antenna 110-1, the feed unit 116-2 for feeding electricity to the second directional antenna 110-2, the feed unit 116-3 for feeding electricity to the third directional antenna 110-3, and the feed unit 116-4 for feeding electricity to the fourth directional antenna 110-4 may be connected to the antenna selection switch 130.

The antenna selection switch 130 may select at least one of the feed units (116-1, 116-2, 116-3, 116-4) according to an input control signal, and may provide signals to the selected feed unit. For convenience of description and better understanding of the present disclosure, the operation for selecting one of the feed units and providing signals to the selected feed unit will hereinafter referred to as "switching".

The control signal applied to the antenna selection switch 170 may be generated by the controller located outside of the antenna apparatus 100, or may also be generated by the controller mounted to the antenna apparatus 100.

In the latter case, the controller contained in the antenna apparatus 100 may control the antenna selection switch 130 upon receiving a control signal from the device (e.g., a vehicle) including the antenna apparatus 100, or may autonomously generate the control signal as necessary.

If the controller is contained in the antenna apparatus 100, all or some of the operations for commanding the controller of the vehicle to control the antenna apparatus 100 may be carried out by the controller of the antenna apparatus 100.

The antenna selection switch 130 may be formed in a common ground substrate to which the plurality of feed units is grounded, and the common ground substrate may be provided below the directional antenna module 110.

In addition, the omni-directional antenna 120 may be connected to the common ground substrate and may be grounded thereto.

In addition, the omni-directional antenna 120 may also be connected to the antenna selection switch 130. If the position of a communication object is recognized and the directional antenna is turned on, the omni-directional antenna 120 may also be turned off.

Figure 15:
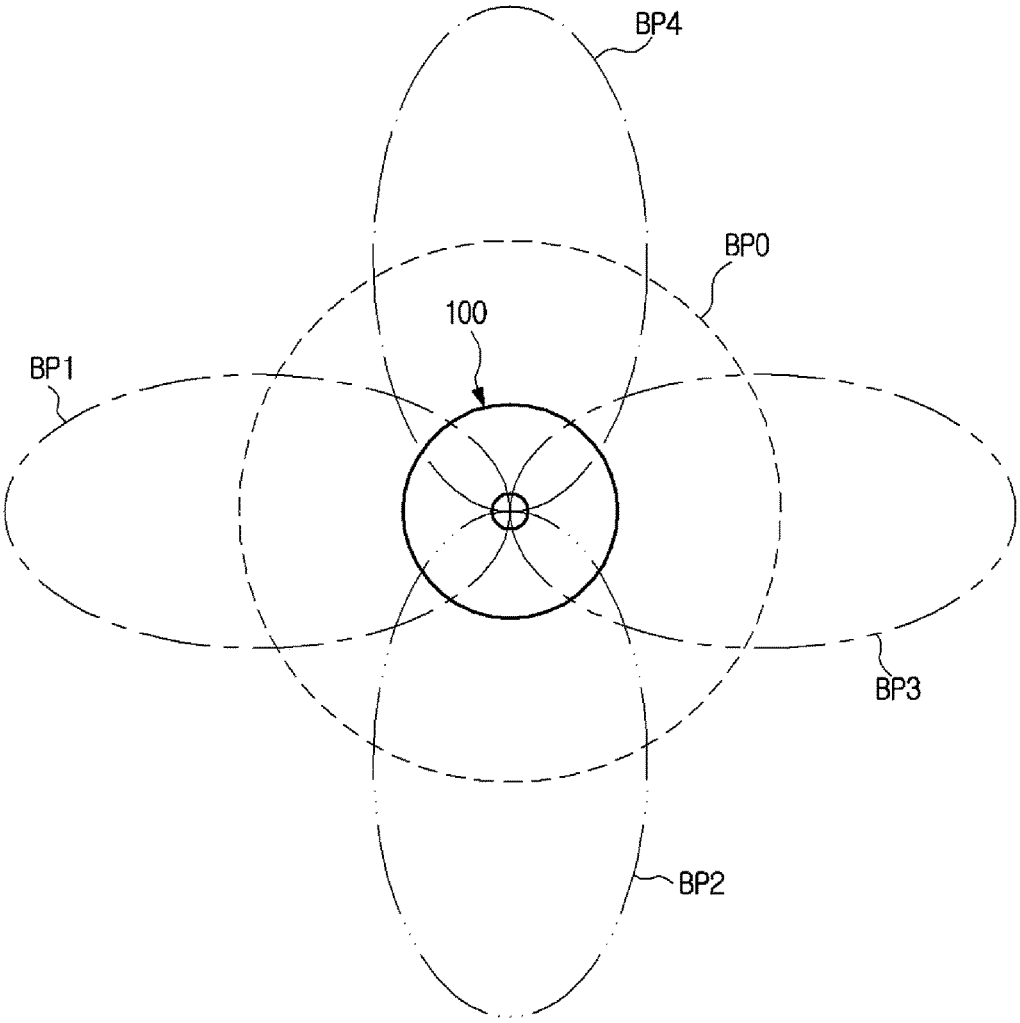
FIG. 15 is a conceptual diagram illustrating a beam pattern of an antenna apparatus according to an embodiment of the present disclosure.

FIG. 15 is a conceptual diagram illustrating a beam pattern of an antenna apparatus according to an embodiment of the present disclosure.

Referring to FIG. 15, the omni-directional antenna 120 of the antenna apparatus 100 may form a beam pattern (BP0) having an omni-directional coverage of 360°. Therefore, under the condition that the position of a communication object is not specified, signals may be transmitted or received omni-directionally through the omni-directional antenna 120.

The directional antenna module 110 may form a plurality of beam patterns (BP1, BP2, BP3, BP4) having directivity for each directional antenna. As shown in the above example, if the directional antenna module 110 includes the first directional antenna 110-1, the second directional antenna 110-2, the third directional antenna 110-3, and the fourth directional antenna 110-4, a range of about 90° may be covered by each antenna. Therefore, the antenna configured to cover the signal transmission or reception direction may be selected and the selected antenna can communicate with the directional antenna module 110.

In the meantime, it should be noted that the beam pattern direction can also be more precisely adjusted by increasing the number of uni-directional antennae contained in the directional antenna module 110 without departing from the scope or spirit of the present disclosure.

A vehicle including the above-mentioned antenna apparatus 100 according to the embodiment will hereinafter be described with reference to the attached drawings.

The RF signals transmitted/received through the antenna according to the embodiment may be signals based on a 2G communication scheme, a 3G communication scheme, a 4G communication scheme, and/or a 5G communication scheme. For example, the 2G communication scheme may be Time Division Multiple Access (TDMA), Code Division Multiple Access (CDMA), etc. For example, the 3D communication scheme may be Wideband Code Division Multiple Access (WCDMA), CDMA2000 (Code Division Multiple Access 2000), Wireless Broadband (WiBro), World Interoperability for Microwave Access (WiMAX), etc. For example, the 4G communication scheme may be Long Term Evolution (LTE), Wireless Broadband Evolution, etc.

For example, the 5G communication scheme may provide a maximum transfer rate of 1 Gbps. The 5G communication scheme may support the immersive communication scheme (e.g., UHD (Ultra-HD), 3D, hologram, etc.) through high-capacity transmission. Therefore, a user may more rapidly transmit and receive superhigh-capacity data through the 5G communication scheme. Here, the superhigh-capacity data is more precise and more immersive.

The 5G communication scheme can perform real-time processing with a maximum response time of 1 ms or less. Therefore, the 5G communication scheme can support various real-time services designed to generate reaction before user recognition.

For example, assuming that the 5G communication module is mounted to a vehicle, the vehicle may be used as a communication subject for data communication. Therefore, a vehicle configured to communicate with the external device may receive sensor information from various devices while in motion, may provide an autonomous navigation system through real-time processing, and may provide various remote control methods.

The 5G communication scheme may use a millimeter-wave band. For example, the 5G communication scheme may use a frequency band of about 28 GHz. The size of the antenna apparatus 100 may gradually increase in proportion to the increasing wavelength of the RF signal. That is, as the frequency of the RF signal gradually increases, the antenna apparatus 100 may be gradually reduced in size. Therefore, assuming that the antenna apparatus 100 is used in 5G communication, the antenna apparatus 100 may be implemented as a subminiature and low profile product.

In addition, the vehicle can provide big data services to passengers who ride in the vehicle, through real-time processing and high-capacity transmission services provided through 5G communication. For example, the vehicle can analyze various web information, SNS information, etc. and can provide customized information appropriate for various situations of vehicle passengers. In accordance with one embodiment, the vehicle collects not only various famous restaurants located in the vicinity of a traveling path through big data mining, but also spectacle information, provides the collected information in real time, and can enable the passengers to immediately confirm various kinds of information existing in the vicinity of the traveling region.

In addition, RF relay transmission based on multihop communication may be achieved in the 5G communication network. For example, a first vehicle contained in the network of a base station (BS) may relay a desired RF signal to be transmitted by a third party located outside the BS network, to the BS. Therefore, the region in which the 5G communication network is supported can be extended in size, and at the same time a buffering problem caused by many users (i.e., UEs) present in the cell can be eliminated or reduced.

Meanwhile, the 5G communication scheme can implement Device-to-Device (D2D) communication applicable to vehicles, communication devices, etc. D2D communication may indicate that devices directly transmit and receive RF signals without using the BS. During D2D communication, devices need not transmit and receive RF signals through the BS. RF signals may be directly communicated between devices so as to prevent the occurrence of unnecessary energy consumption.

In this case, the vehicle may perform real-time processing of sensor information associated with other vehicles located in the vicinity of the vehicle according to the 5G communication scheme, may in real-time relay the possibility of collision to the user, and may in real-time provide information regarding traffic situations to be generated on a traveling path.

Figure 16:
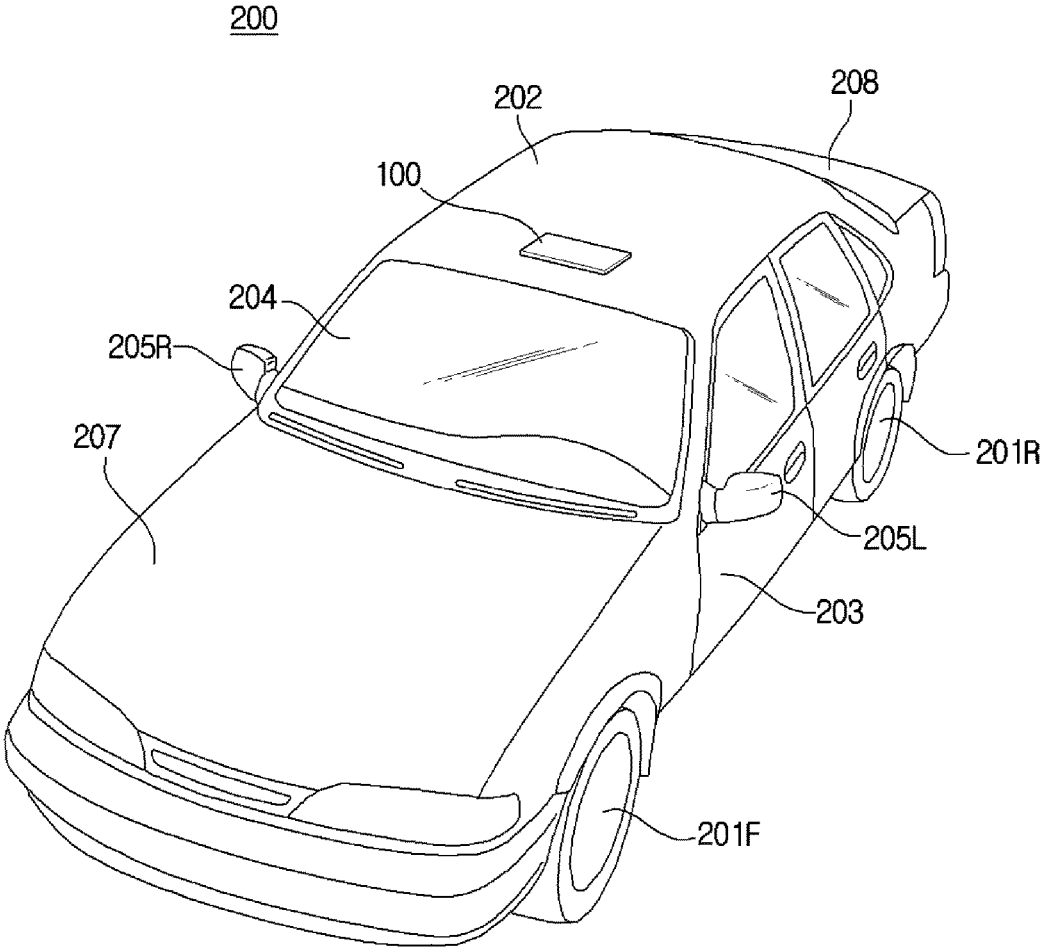
FIG. 16 is a view illustrating an appearance of a vehicle according to an embodiment of the present disclosure.

FIG. 16 is a view illustrating an appearance of a vehicle according to an embodiment of the present disclosure.

Referring to FIG. 16, the vehicle 200 according to the embodiment may include vehicle wheels (201F, 201R) to move the vehicle 200 from place to place; a main body 202 forming the appearance of the vehicle 200; a drive unit (not shown) to rotate the vehicle wheels (201F, 201R); doors 203 to shield an indoor space of the vehicle 200 from the outside; a windshield 204 to provide a forward view from the vehicle 200 to a vehicle driver who rides in the vehicle 200; and side-view mirrors (205L, 205R) to provide a rear view of the vehicle 200 to the vehicle driver.

The wheels (201F, 201R) may include front wheels 201F provided at the front of the vehicle 200 and rear wheels 201R provided at the rear of the vehicle 200. The drive unit contained in an engine hood 207 may provide rotational force to the front wheels 201F or the rear wheels 201R in a manner that the vehicle 200 moves forward or backward.

The drive unit may include an engine to generate rotational force by burning fossil fuels or a motor to generate rotational force upon receiving power from a condenser, capacitor or a battery (not shown).

The doors 203 may be rotatably provided at the right and left sides of the main body 202 so that a vehicle driver can enter the vehicle 200 when any of the doors 203 are open and an indoor space of the vehicle 200 can be shielded from the outside when the doors 203 are closed.

The windshield 204 is provided at a front upper portion of the main body 202 so that a vehicle driver who rides in the vehicle 200 can obtain visual information in a forward direction of the vehicle 200. The windshield 204 may also be referred to as windshield glass.

The side-view mirrors (205L, 205R) may include a left side-view mirror 205L provided at the left of the main body 202 and a right side-view mirror 205R provided at the right of the main body 202, so that the driver who rides in the vehicle 200 can obtain visual information in the lateral and rear directions of the main body 202.

The antenna apparatus 100 may be mounted to the outside of the vehicle 200. The antenna apparatus 100 may be implemented as a subminiature and low profile product, may be disposed over the engine hood 207, and may also be integrated with the shark antenna mounted to the top part of a rear glass.

In addition, two or more antenna apparatuses 100 may also be mounted to the vehicle as necessary. For example, the antenna apparatus 100 configured to cover the forward direction of the vehicle may be mounted to the top of the engine hood 207, and the antenna apparatus 100 configured to cover the backward, or rear, direction of the vehicle may be mounted to the shark antenna or a trunk of the vehicle.

The position or number of the antenna apparatuses 100 may not be limited thereto, and the appropriate position or number of the antennae 100 may be determined in consideration of the usage of the antenna apparatus 100, a vehicle design, propagation directivity, etc.

Figure 17:
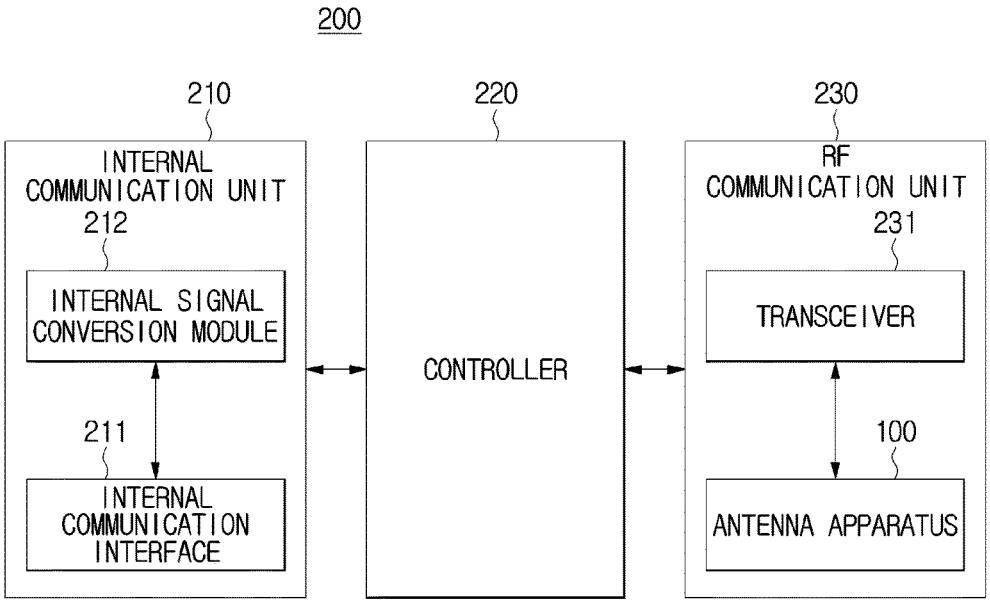
FIG. 17 is a control block diagram illustrating a vehicle according to an embodiment of the present disclosure.

FIG. 17 is a control block diagram illustrating a vehicle according to an embodiment of the present disclosure.

Various constituent elements related to vehicle communication are shown in FIG. 17, and other constituent elements related to other operations such as vehicle driving or internal environment control will herein be omitted for convenience of description. Therefore, the scope or spirit of the present disclosure is not limited thereto, and can also be applicable to other examples without change. Referring to FIG. 17, the vehicle 200 may include an internal communication unit 210 configured to communicate with various electronic devices installed in the vehicle 200 through the vehicle communication network installed in the vehicle 200; a radio frequency (RF) communication unit 230 configured to communicate with a user equipment (UE), a server, or other vehicles located outside of the vehicle 200; and a controller 220 configured to control the internal communication unit 210 and the RF communication unit 230.

The internal communication unit 210 may include an internal communication interface 211 connected to the vehicle communication network, and an internal signal conversion module 212 configured to modulate/demodulate a signal.

The internal communication interface 211 may receive a communication signal from various electronic devices contained in the vehicle 200 through the vehicle communication network, and may transmit the communication signal to various electronic devices contained in the vehicle 200 through the vehicle communication network. In this case, the communication signal may be transmitted and received through the vehicle communication network.

The internal communication interface 211 may include a communication port, and a transceiver configured to perform transmission and reception of signals.

The internal signal conversion module 212 may demodulate the communication signal received through the internal communication interface 211 into a control signal, and may modulate the control signal generated by the controller 220 into an analog communication signal such that the analog communication signal can be transmitted through the internal communication interface 211.

The internal signal conversion module 212 may modulate the control signal generated from the controller 220 into a communication signal according to a communication protocol of the vehicle network, and may demodulate the communication signal based on the vehicle network communication protocol into a control signal capable of being recognized by the controller 220.

The internal signal conversion module 212 may include a memory configured to store a program and data needed for modulating/demodulating a communication signal, and a processor configured to modulate/demodulate a communication signal according to the program and data stored in the memory.

The controller 220 may control the internal signal conversion module 212 and the communication interface 211. For example, if the communication signal is transmitted, the controller 220 may determine whether the communication network is occupied by another electronic device through the communication interface 211. If the communication network is empty, the controller 220 may control the internal communication interface 211 and the internal signal conversion module 212 to transmit the communication signal. In addition, if the communication signal is received, the controller 220 may control the internal communication interface 211 and the signal conversion module 212 to demodulate the communication signal received through the communication interface 211.

The controller 220 may include a memory configured to store a program and data needed to control the internal signal conversion module 212 and the communication interface 211, and a processor configured to generate a control signal according to the program and data stored in the memory.

In addition, the controller 220 may be contained in an electronic control unit (ECU) configured to control the vehicle 1, or may be separated from the ECU. The controller 220 may also share the processor contained in the internal communication unit 210 or the RF communication unit 230.

The RF communication unit 330 may include a transceiver 331 to modulate/demodulate signals; and an antenna apparatus 100 to transmit or receive signals to and/or from the outside.

The transceiver 231 may include a receiver to demodulate the RF signal received through the antenna apparatus 100, and a transmitter to modulate RF modulation for transmitting the control signal generated from the controller 220 to the outside.

In addition, the RF signal may include a desired signal into a high-frequency carrier (for example, about 28 GHz in case of 5G communication) such that the desired signal can be transmitted through the high-frequency carrier. To this end, the transceiver 231 may modulate the high-frequency carrier upon receiving the control signal from the controller 220, may generate a transmission signal, may demodulate the signal received through the antenna apparatus 100, and may reconstruct the control signal.

For example, the transceiver may include an encoder (ENC), a modulator (MOD), a multiple input multiple output encoder (MIMO ENC), a precoder, an Inverse Fast Fourier Transformer (IFFT), a Parallel to Serial (P/S) converter, a cyclic prefix (CP) insertion unit, a Digital to Analog Converter (DAC) and/or a frequency conversion unit.

L control signals may be input to the MIMO ENC through the encoder (ENC) and the modulator (MOD). M streams generated from the MIMO ENC may be precoded by the precoder, such that the M streams are converted into N precoded signals. The precoded signals may be converted into analog signals after passing through the IFFT, the P/S converter, the cyclic prefix (CP) insertion unit, and/or the DAC. The analog signals generated from the DAC may be converted into a radio frequency (RF) band through the frequency conversion unit.

The transceiver 231 may include a memory configured to store a program and data needed for modulating/demodulating a communication signal, and a processor configured to modulate/demodulate a communication signal according to the program and data stored in the memory.

However, the scope or spirit of the transceiver 231 is not limited to the example of FIG. 17, and may also be implemented in various ways according to a variety of communication schemes.

The vehicle 200 may communicate with the external server or control center through the antenna apparatus 100, such that the vehicle 200 may transmit or receive real-time traffic information, accident information, vehicle status information, etc. In addition, the vehicle 200 may communicate with other vehicles so as to transmit/receive sensor information measured by sensors embedded in each vehicle to/from other vehicles, such that the vehicle 200 may adaptively cope with road situations, or may collect information related to an accident or other adverse event. In this case, the sensors embedded in the vehicle may include at least one of an image sensor, an acceleration sensor, a collision sensor, a gyro sensor, a steering angle sensor, a vehicle speed sensor, etc.

Figure 18:
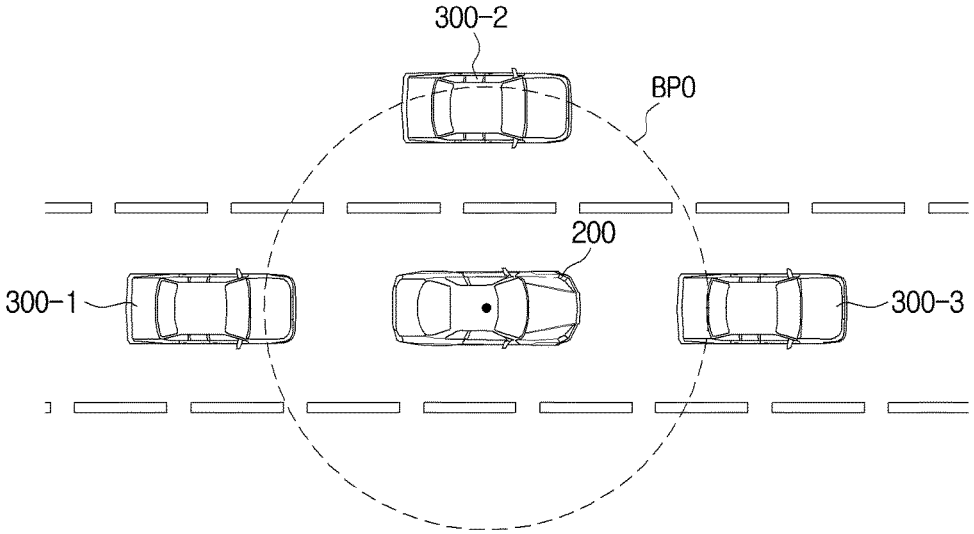
FIGS. 18 to 20 are conceptual diagrams illustrating a method for controlling a vehicle to communicate with one or more peripheral vehicles according to an embodiment of the present disclosure.
Figure 19:
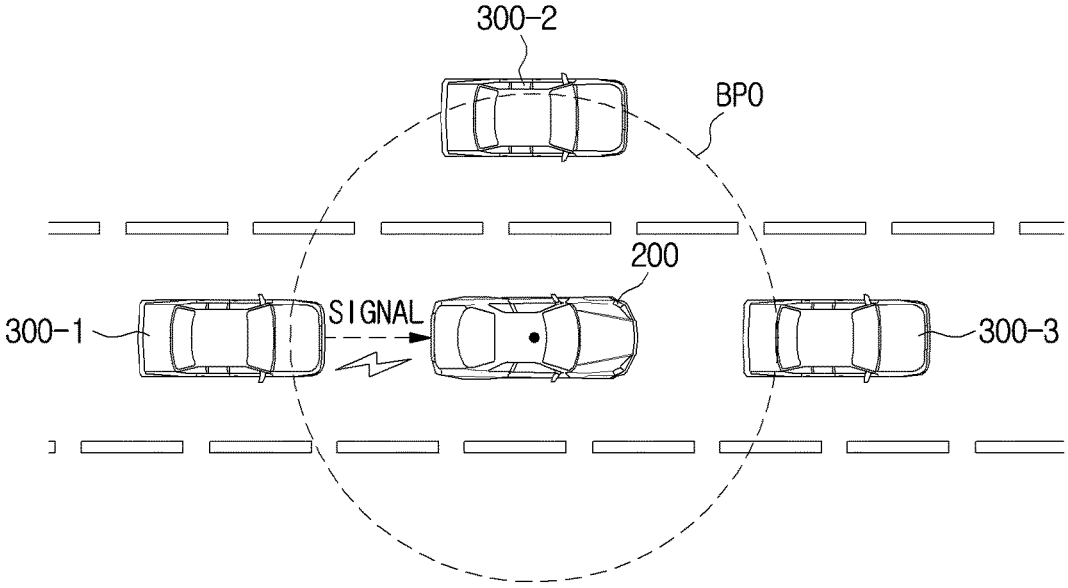
Figure 20:
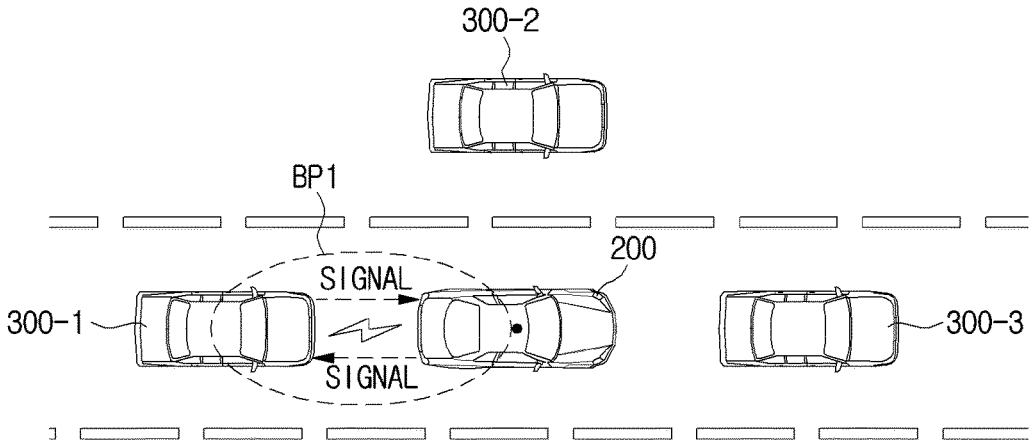

FIGS. 18 to 20 are conceptual diagrams illustrating a method for controlling a vehicle to communicate with one or more peripheral vehicles according to an embodiment of the present disclosure.

Referring to FIG. 18, during the standby mode, the omni-directional 120 may receive signals from other peripheral devices (300-1, 300-2, 300-3).

Referring to FIG. 19, if one peripheral vehicle 300-1 transmits a signal, the omni-directional antenna 120 receives the signal. The signal transmitted from the peripheral vehicle 300-1 may be a request signal or pilot signal for communication connection.

In this case, the output signal of the peripheral 300-1 may include positional information of the peripheral 300-1. For example, the positional information may be GPS information.

The signal received from the omni-directional antenna 120 may be transmitted to the controller 220 through the transceiver 231. The controller 220 may select the directional antenna to be used for communication on the basis of GPS information contained in the reception signal.

In more detail, the controller 220 may determine the position of the peripheral vehicle 300-1 that has transmitted the signal on the basis of GPS information contained in the reception signal, and may determine the directional antenna corresponding to the position of the peripheral vehicle 300-1.

Referring to FIG. 20, assuming that the directional antenna corresponding to the position of the peripheral vehicle 300-1 is the first directional antenna 100-1, the controller 220 may transmit a control signal to the antenna selection switch 130 and provide electricity to the first directional antenna 110-1. The first directional antenna 110-1 may form the beam pattern BP0 capable of covering the peripheral vehicle 300-1, and then transmit a signal.

Figure 21:
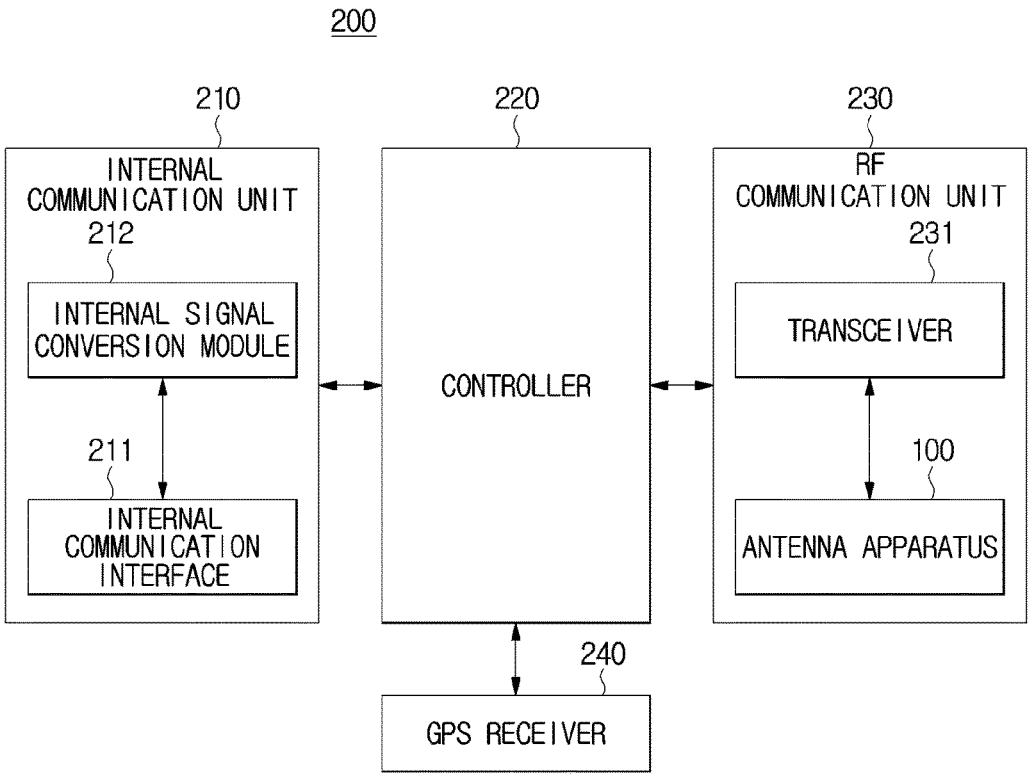
FIG. 21 is a block diagram illustrating a vehicle further including a GPS receiver.

FIG. 21 is a block diagram illustrating a vehicle further including a GPS receiver.

Referring to FIG. 21, the vehicle 200 may further include a GPS receiver 240.

The GPS receiver 240 may receive positional information of the vehicle 1 from the GPS satellite.

The controller 220 may select at least one directional antenna on the basis of the peripheral vehicle positional information received from the peripheral vehicle 300-1 and the vehicle 200's position information received by the GPS receiver 240.

For example, the controller 220 may compare the peripheral vehicle positional information received from the peripheral vehicle 300-1 with the vehicle 200's positional information received by the GPS receiver, and then determine a relative position of the peripheral vehicle 300-1, and may select either an antenna corresponding to a relative position of the peripheral vehicle 300-1 (i.e., the antenna capable of transmitting the signal to the peripheral vehicle 300-1, a relationship position of which has been decided.) or the other antenna capable of covering the direction of the peripheral vehicle 300-1.

If the controller 220 transmits the control signal for providing electricity to the selected antenna to the RF communication unit 230, the antenna selection switch 130 may select the antenna according to a control signal and provide electricity to the selected antenna.

If the vehicle 200 having received the request signal or the pilot signal from the peripheral vehicle 300-1 transmits a signal to the peripheral vehicle 300-1, the vehicle 200 and the peripheral vehicle 300-1 can communicate with each other such that signals can be communicated between the two vehicles (200, 300-1). In this case, the signal transmitted from the vehicle 200 may be a response signal.

After completion of a communication connection between the two vehicles, the signal transmitted from the peripheral vehicle 300-1 may include GPS information. When the vehicle 200 transmits the signal to the peripheral vehicle 300-1, the vehicle 200 may also transmit its own GPS information received by the GPS receiver 240.

Whenever the controller 220 receives GPS information from the peripheral vehicle 300-1, the controller 220 may select the antenna on the basis of the received GPS information, and may transmit a control signal to the antenna selection switch 130. Therefore, although the communication object (i.e., the peripheral vehicle 300-1 or the vehicle 200) moves to another place during communication, the vehicle 200 may selectively switch the antenna according to the positional movement of the peripheral vehicle 300-1, such that the vehicle 200 can easily communicate with the peripheral vehicle 300-1.

In addition, if the distance between the peripheral vehicle 300-1 and the vehicle 200 is a short distance equal to or less than a predetermined reference distance, or if the vehicle 200 can communicate with the peripheral vehicle 300-1 using the omni-directional antenna 120 without difficulty, the controller 220 may not select the directional antenna module 110 and may also perform communication using the omni-directional antenna 120.

In addition, the controller 220 may also select two or more directional antennae. For example, if the relative position of the peripheral vehicle 300-1 considering the error range of GPS information covers two or more beam patterns, two or more antennae for forming the corresponding beam pattern may be selected.

In addition, if the relative position of the peripheral vehicle escapes from the coverage of the directional antenna module 110, the controller 220 may determine an unavailable communication state and may visually or audibly inform the user of the unavailable communication state. For example, in order to visually indicate the unavailable communication state, the display unit of the AVN terminal embedded in the vehicle may be used. In order to audibly indicate the unavailable communication state, a speaker of the vehicle may be used.

Meanwhile, if the vehicle 200 first transmits the signal, the pilot signal or the request signal may be transmitted through the omni-directional antenna 120, and a response signal from the peripheral vehicle acting as a communication object may be received through the omni-directional antenna 120. In this case, the response signal received from the peripheral vehicle may include positional information of the corresponding peripheral vehicle, and GPS information of the vehicle 200 may also be contained in the signal transmitted from the vehicle 200.

The operations subsequent to the completion of receiving the response signal including the GPS information from the peripheral vehicle are identical to the above-mentioned examples, and as such a detailed description thereof will herein be omitted for convenience of description.

FIGS. 22 to 26 are conceptual diagrams illustrating another method for controlling a vehicle to communicate with one or more peripheral vehicles according to embodiments of the present disclosure.

As can be seen from this example, the vehicle may receive the signal from the peripheral vehicle through the omni-directional antenna 120 during a standby mode.

Figure 22:
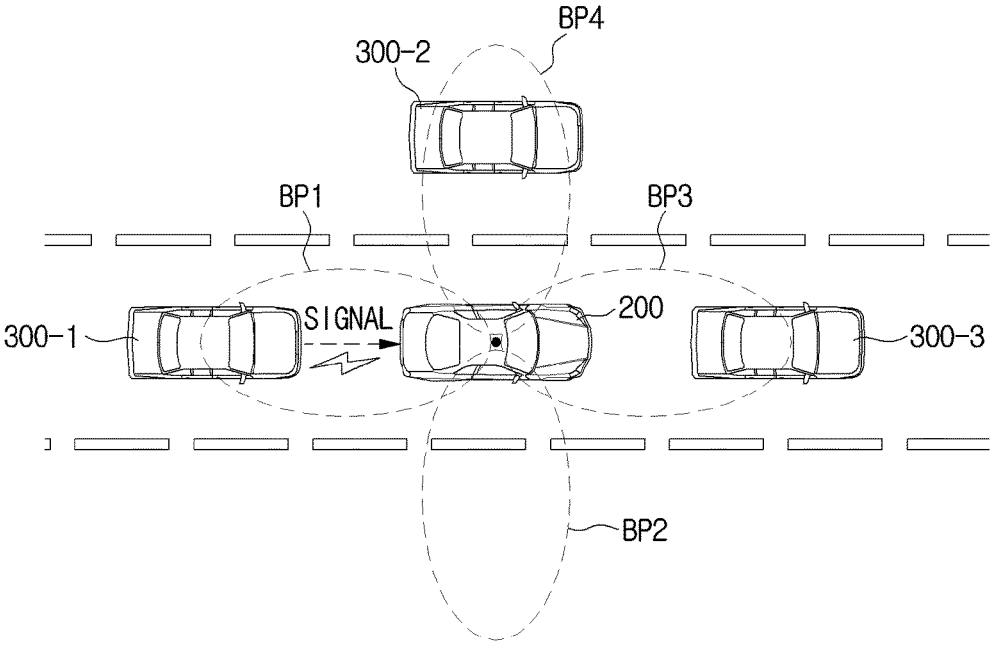
FIGS. 22 to 26 are conceptual diagrams illustrating another method for controlling a vehicle to communicate with one or more peripheral vehicles according to an embodiment of the present disclosure.

Upon receiving one or more signals from at least one of the peripheral vehicles (300-1, 300-2, 300-2), the controller 220 may switch on the plurality of directional antennae (110-1, 110-2, 110-3, 110-4) contained in the directional antenna module 110, as shown in FIG. 22. The above-mentioned operation for switching on the antenna may indicate that the corresponding antenna is electrically connected to the antenna selection switch 130 or to the transceiver. In more detail, the above-mentioned operation for switching on the antenna may indicate the operation for transmitting one or more signals by providing electricity to the antenna or the operation for receiving one or more signals through the antenna.

The controller 220 may select one directional antenna to be used for communication from among the directional antennae (110-1, 110-2, 110-3, 110-4). The controller 220 may determine a relative position of the peripheral vehicle 300-1 on the basis of specific information indicating which directional antenna has received the signal. That is, the controller 220 may determine that the peripheral vehicle 300-1 is located in a direction (i.e., a direction corresponding to coverage of the corresponding directional antenna) corresponding to the directional antenna having received the signal.

Therefore, the controller 220 may determine that the directional antenna having received the signal is an antenna corresponding to the position of the peripheral vehicle having transmitted the signal or is an antenna capable of covering the peripheral vehicle having transmitted the signal. Therefore, the directional antenna having received the signal may be selected as the antenna to be used for communication.

Figure 23:
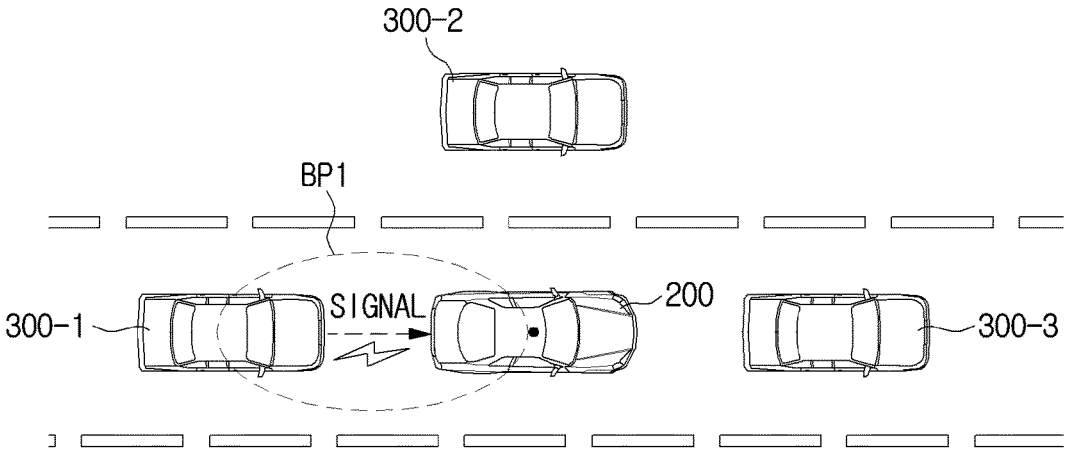

For example, assuming that the first directional antenna 110-1 from among the plurality of directional antennae (110-1, 110-2, 110-3, 110-4) receives the signal from the peripheral vehicle 300-1, the controller 220 may switch off the remaining antennae (110-2, 110-3, 110-4) and may switch on the first directional antenna 110-1 only, as shown in FIG. 23.

Figure 24:
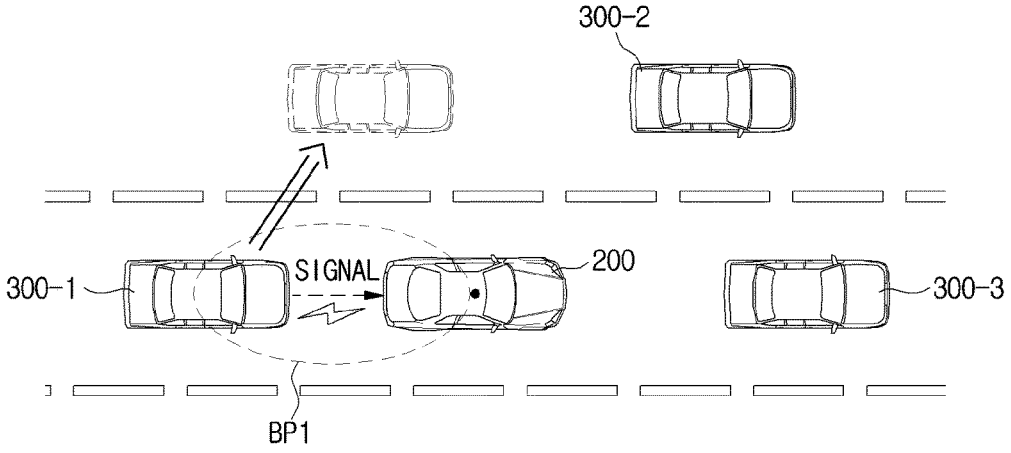

In addition, assuming that the peripheral vehicle 300-1 or the vehicle 200 moves from one place to another place such that a relative position between the two vehicles (300-1, 200) is changed as shown in FIG. 24, the controller 220 may detect the change of a relative position on the basis of intensity of the received signal, may re-select the antenna and thus change a beam pattern to another beam pattern. Received Signal Strength Indicator (RSSI) may be used to indicate the intensity of the received signal.

Figure 25:
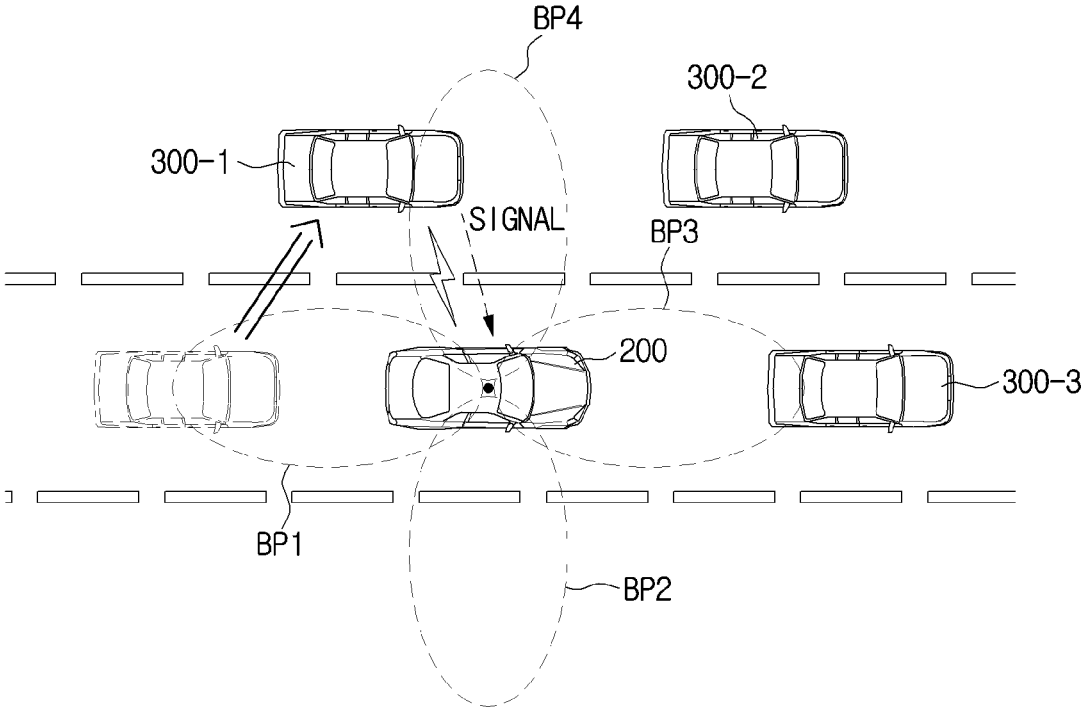

For example, if the intensity of the signal received from the peripheral vehicle 300-1 is equal to or less than a reference level, the controller 220 may switch on all the antennae (110-1, 110-2, 110-3, 110-4) contained in the directional antenna module 110, as shown in FIG. 25.

The controller 220 may determine the changed relative position on the basis of specific information indicating which one of the directional antennae (110-1, 110-2, 110-3, 110-4) is used to receive signals, and may re-select the directional antenna having received the signal as the antenna to be used for communication.

Figure 26:
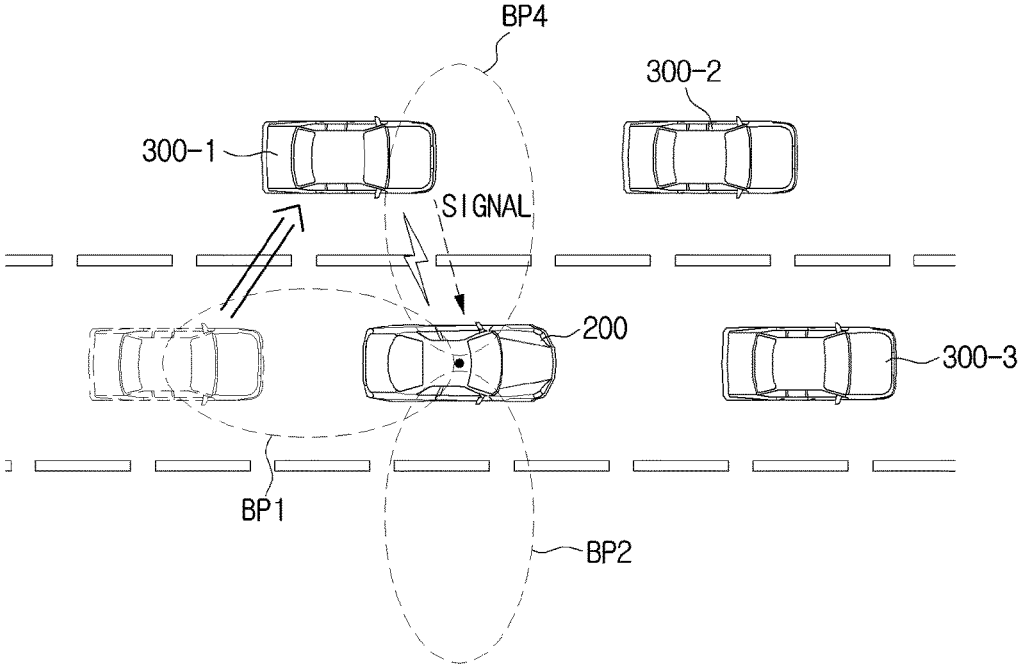

Alternatively, as shown in FIG. 26, only the antennae (110-4, 110-2) adjacent to the switched-on antenna 110-1 may also be switched on as necessary. In this case, the controller 220 may also re-select the antenna to be used for communication on the basis of specific information indicating which one of the directional antennae (110-4, 110-2) receives signals.

In addition, assuming that the antenna having received the signal is not present in the contiguous antennae (110-4, 110-2), the antenna 110-3 adjacent to the contiguous antennae (110-4, 110-2) is turned on such that it can determine reception or non-reception of the signal.

In the meantime, if the vehicle 200 first transmits the signal, the vehicle 200 may transmit the pilot signal or the request signal through the omni-directional antenna 120, and may switch on all the directional antennae (110-1, 110-2, 110-3, 110-4) of the directional antenna module 110, such that the vehicle 200 may receive a response signal from the peripheral vehicle acting as the communication object.

The controller 220 may determine that the antenna having received the signal from the peripheral vehicle from among the plurality of directional antennae (110-1, 110-2, 110-3, 110-4) corresponds to the position of the peripheral vehicle, and may select the determined antenna as an antenna to be used for communication. The subsequent processes are identical to those of the above-mentioned embodiments.

If any one of the directional antennae (110-1, 110-2, 110-3, 110-4) does not receive the signal, the controller 220 may determine the presence of an unavailable communication state, and may visually or audibly inform the user of the unavailable communication state.

The operations of the controller 220 related to control of the antenna apparatus 100 may also be carried out by the antenna apparatus 100. That is, the controller implemented as the processor for performing the above-mentioned control action may be contained in the antenna apparatus 100, and the transceiver may also be contained in the antenna apparatus 100 as necessary. In this case, the position of a communication object in the antenna apparatus 100 and the directional antenna corresponding to the communication object position may be determined.

A method for controlling the antenna apparatus according to an embodiment will hereinafter be described with reference to the attached drawings. The antenna apparatus 100 according to the above-mentioned embodiment is used to perform the control method of the antenna apparatus, and the above-mentioned contents shown in FIGS. 1 to 26 can also be applied to the control method of the antenna apparatus to be described later.

Figure 27:
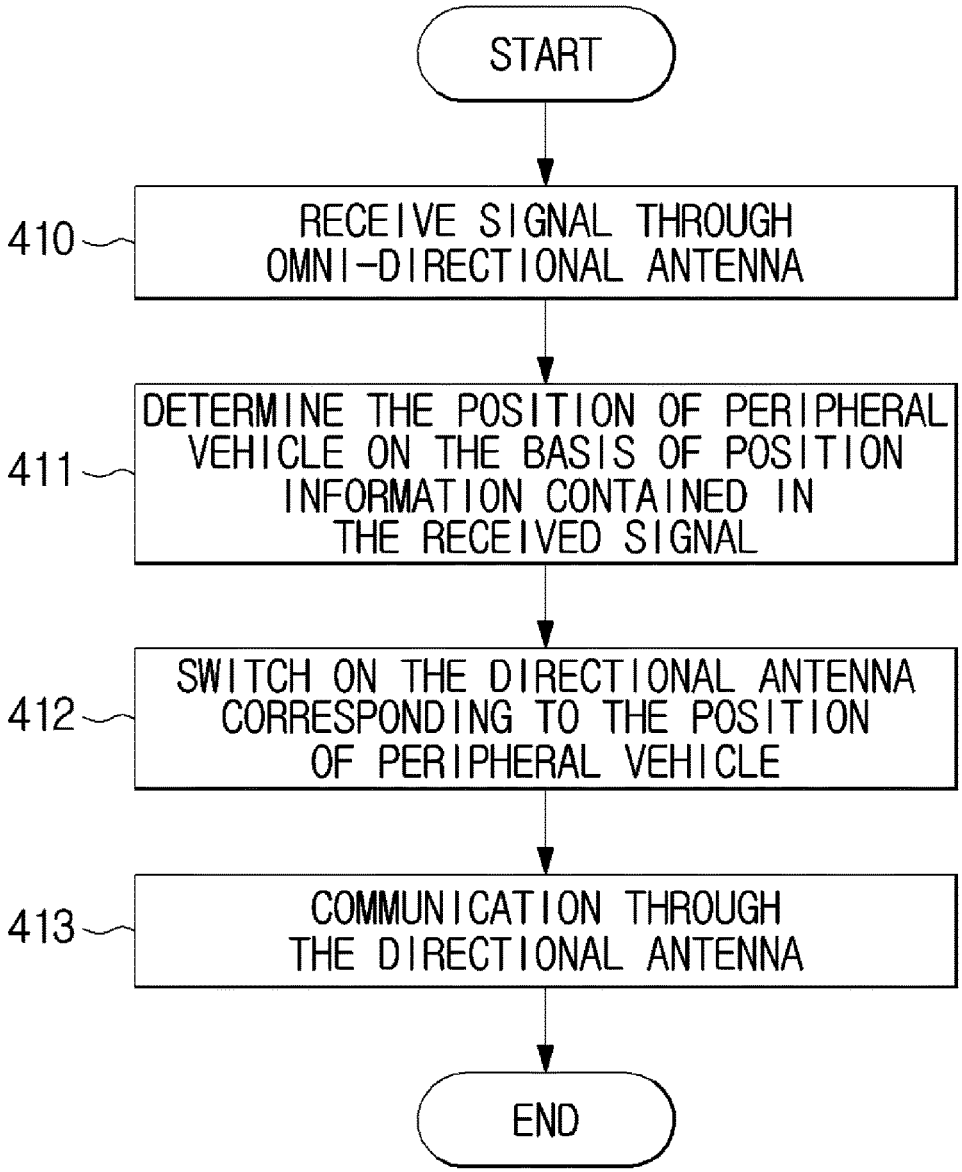
FIG. 27 is a flowchart illustrating a method for controlling an antenna apparatus according to an embodiment of the present disclosure.

FIG. 27 is a flowchart illustrating a method for controlling an antenna apparatus according to an embodiment of the present disclosure.

Referring to FIG. 27, the omni-directional antenna 120 may receive signals from the peripheral vehicle in operation 410. The signal transmitted from the peripheral vehicle may be the pilot signal or the request signal. This signal may include positional information of the peripheral vehicle, for example, GPS information.

The controller 220 may determine the position of the peripheral vehicle on the basis of positional information contained in the received signal in operation 411. For example, the controller 220 may select at least one of the directional antennae (110-1, 110-2, 110-3, 110-4) on the basis of the peripheral vehicle positional information received from the peripheral vehicle 300-1 and the vehicle 200's positional information received by the GPS receiver 240.

For example, the controller 220 may compare the peripheral vehicle positional information received from the peripheral vehicle 300-1 with the vehicle 200's positional information received by the GPS receiver 240, and then determine a relative position of the peripheral vehicle 300-1, and may select either an antenna corresponding to a relative position of the peripheral vehicle 300-1 (i.e., the antenna capable of transmitting the signal to the peripheral vehicle 300-1, a relationship position of which has been decided) or the other antenna capable of covering the direction of the peripheral vehicle 300-1.

The antenna corresponding to the position of the peripheral vehicle may be switched on in operation 412. For this purpose, the controller 220 may transmit a control signal for providing electricity to the selected antenna to the antenna selection switch 130. The antenna selection switch 130 may provide electricity to the selected antenna according to the control signal.

If the response signal is transmitted to the peripheral vehicle 300-1 through the selected antenna, the two vehicles (200, 300-1) can communicate with each other through the selected antenna in operation 413. That is, the two vehicles (200, 300-1) may communicate with each other through the selected antenna.

Upon completion of a communication connection, the peripheral vehicle 300-1 may include its own positional information in the signal and then transmit the resultant signal. Whenever the controller 220 receives the signal, the controller 220 may determine the relative positional information between the peripheral vehicle 300-1 and the vehicle 200 in operation 411, and may then switch on the directional antenna corresponding to the relative position information in operation 412. During the communication mode, the above-mentioned processes may be repeatedly carried out. Therefore, although the relative position may be flexibly changed according to movement of the vehicle 200 or the peripheral 300-1, the directional antenna corresponding to the changed positional information may also be changed.

In addition, the positional information of the vehicle 200 may also be transmitted to the peripheral vehicle 300-1 without departing from the scope or spirit of the present disclosure.

Meanwhile, if the vehicle 200 first transmits the signal, the vehicle 200 may transmit the pilot signal or the request signal through the omni-directional antenna 120, and may receive a response signal from the peripheral vehicle acting as the communication object through the omni-directional antenna 120. In this case, the response signal received from the peripheral vehicle may include the positional information of the corresponding peripheral vehicle, and the signal transmitted from the vehicle 200 may further include the positional information of the vehicle 200 as necessary.

Upon receiving the response signal including the positional information from the peripheral vehicle, the subsequent processes are identical to those of the above-mentioned examples.

In addition, if the relative position of the peripheral vehicle escapes from the coverage of the directional antenna module 110, the controller 220 may determine the presence of an unavailable communication state, and may visually or audibly inform the user of the unavailable communication state.

Figure 28:
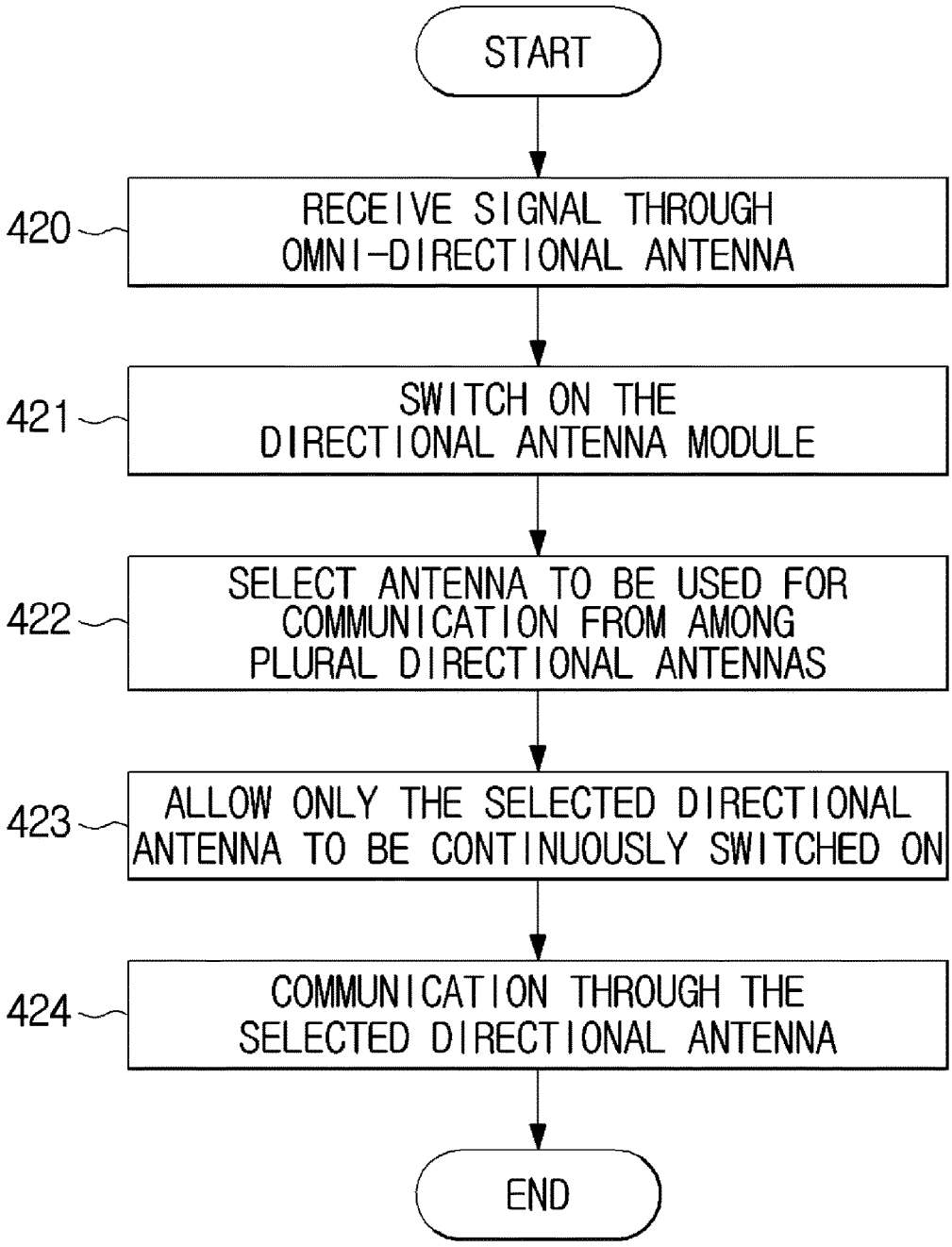
FIG. 28 is a flowchart illustrating another method for controlling an antenna apparatus according to an embodiment of the present disclosure.

FIG. 28 is a flowchart illustrating another method for controlling an antenna apparatus according to an embodiment of the present disclosure.

Referring to FIG. 28, the vehicle may receive a signal from the peripheral vehicle through the antenna 120 in operation 420. In the same manner as in the above-mentioned example, the reception signal may be a request signal or a pilot signal The directional antenna module may be turned on in operation 421. That is, all the directional antennae (110-1, 110-2, 110-3, 110-4) contained in the directional antenna module 110 may be turned on.

One antenna to be used for communication from among the plurality of directional antennae may be selected in operation 422. It may be determined that the peripheral vehicle is located either in the direction corresponding to the beam pattern formed by the directional antenna having received the signal, or in the coverage of the corresponding beam pattern. Therefore, the controller 220 may select the antenna having received the signal from among the plurality of directional antennae (110-1, 110-2, 110-3, 110-4) as an antenna to be used for communication.

Only the selected directional antenna may be continuously turned on in operation 423. For example, assuming that the first directional antenna 110-1 from among the plurality of directional antennae (110-1, 110-2, 110-3, 110-4) receives the signal from the peripheral vehicle 300-1, the controller 220 may switch off the remaining antennae (110-2, 110-3, 110-4) and may provide electricity only to the first directional antenna 110-1.

If the vehicle 200 transmits a response signal to the peripheral vehicle 300-1 by providing electricity to the first directional antenna 110-1, the vehicle 200 may communicate with the peripheral vehicle 300-1 through the first directional antenna 110-1 in operation 424.

Meanwhile, if the vehicle 200 first transmits a signal, the vehicle 200 may transmit the pilot signal or the request signal through the directional antenna 120, all the directional antennae (110-1, 110-2, 110-3, 110-4) of the directional antenna module 110 may be turned on such that the vehicle 200 can receive a response signal from the peripheral vehicle acting as a communication object.

The controller 220 may determine that the antenna having received the signal from among the directional antennae (110-1, 110-2, 110-3, 110-4) from the peripheral vehicle corresponds to the position of the peripheral vehicle, and may determine the corresponding antenna to be an antenna to be used for communication. The subsequent processes are identical to those of the above-mentioned embodiments.

Assuming that any one of the directional antennae (110-1, 110-2, 110-3, 110-4) does not receive signals, the controller 220 may determine an unavailable communication state, and may visually or audibly inform the user of the unavailable communication state.

Figure 29:
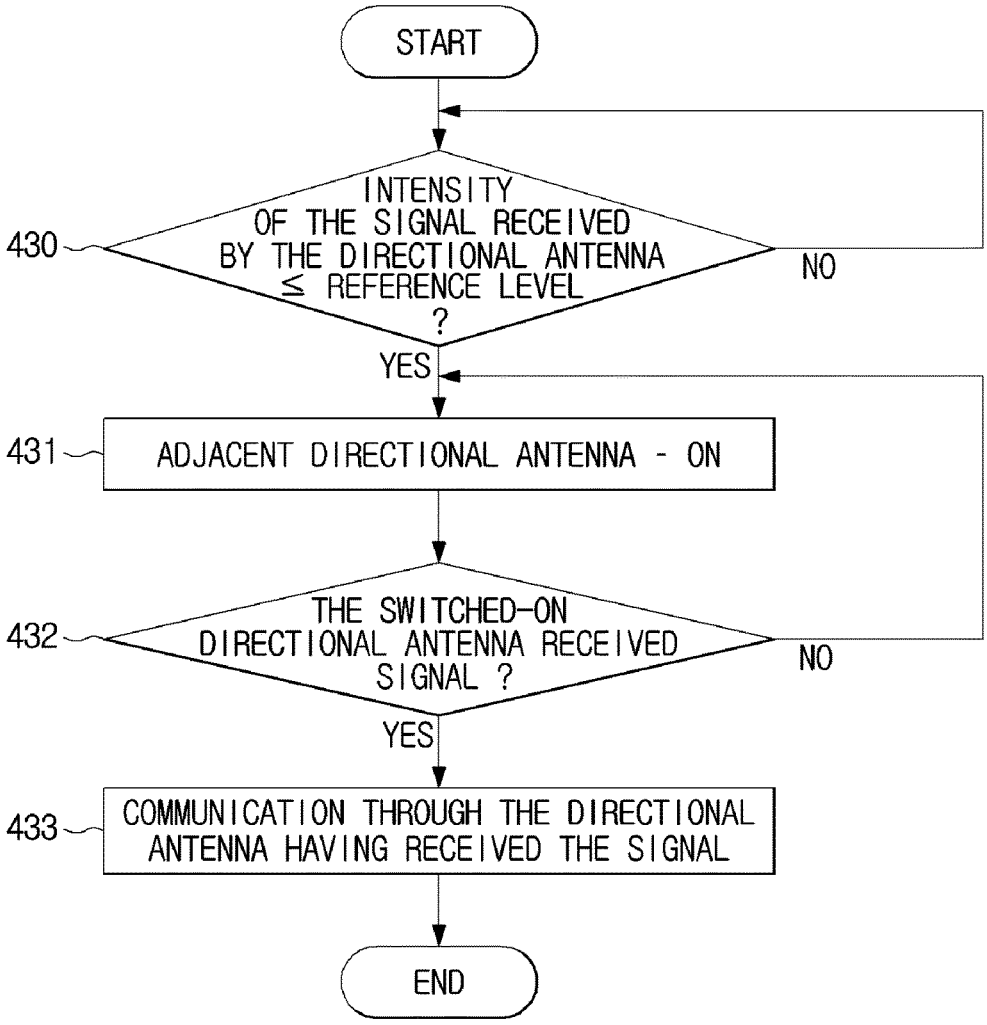
FIGS. 29 and 30 are flowcharts illustrating another method for controlling an antenna apparatus when a relative position between a vehicle and peripheral vehicles is changed, according to an embodiment of the present disclosure.
Figure 30:
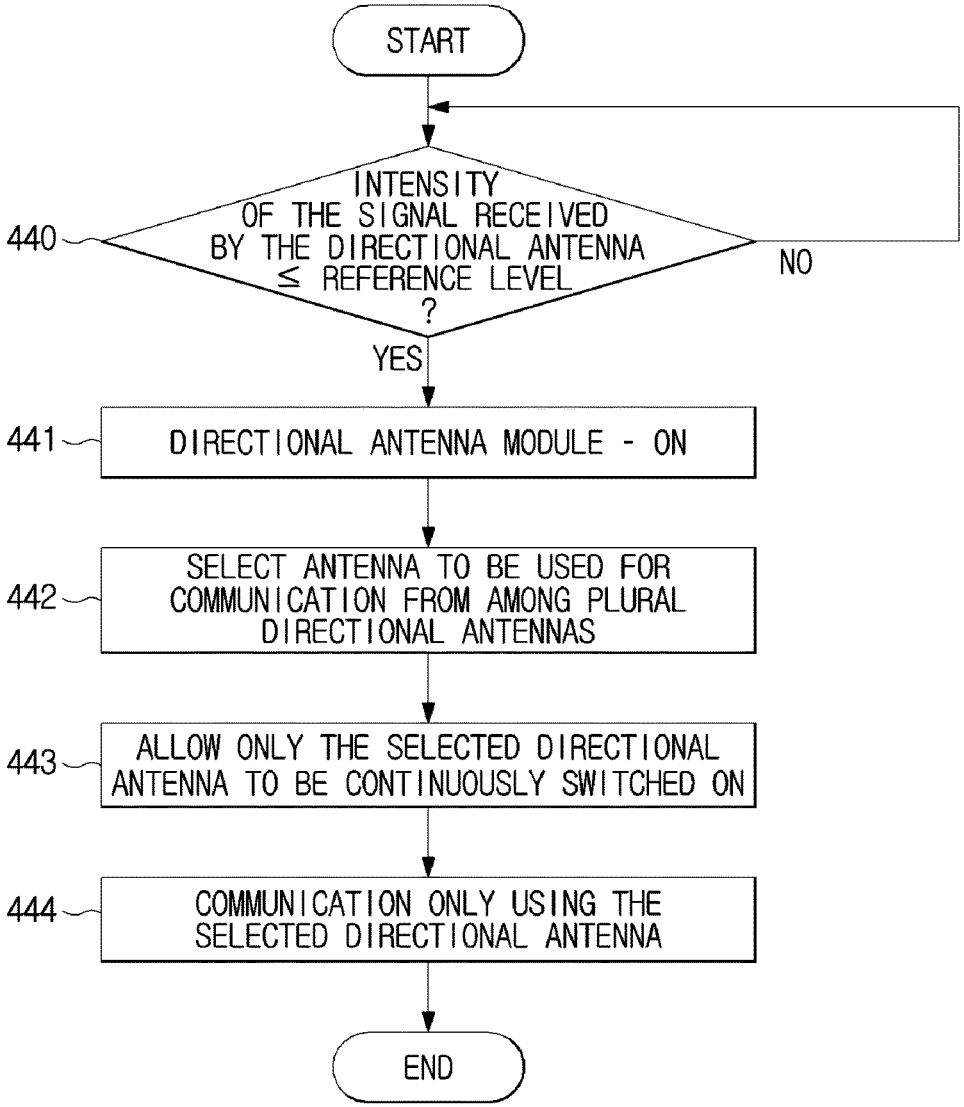

FIGS. 29 and 30 are flowcharts illustrating another method for controlling an antenna apparatus when a relative position between a vehicle and peripheral vehicles is changed.

It is assumed that one of the directional antennae is selected such that a communication mode between two vehicles is established as shown in FIG. 28. Referring to FIG. 29, the controller 220 may compare an intensity of the signal received by the directional antenna with a reference level in operation 430. If the intensity of the reception signal is equal to or less than a reference level in operation 430, the directional antenna adjacent to the currently switched-on directional antenna is then switched on in operation 431.

If the switched-on directional antenna receives the signal in operation 432, a communication mode may be established using the directional antenna having received the signal in operation 433. That is, it is determined that the relative position of the peripheral vehicle is changed to another position corresponding to the directional antenna having received the signal, and communication may be established using the corresponding directional antenna.

If the switched-on directional antenna does not receive the signal in operation 432, the antenna adjacent to the currently switched-on directional antenna is switched on in operation 431, and the above-mentioned operations are then repeated.

Referring to FIG. 30, the controller 220 may compare an intensity of the signal received by the directional antenna with a reference level in operation 440. If the intensity of the reception signal is equal to or less than a reference level in operation 440, the directional antenna module is turned on in operation 441.

The controller 220 may select an antenna to be used for communication from among the plurality of directional antennae in operation 442.

It may be determined that the peripheral vehicle is located either in the direction corresponding to the beam pattern formed by the directional antenna having received the signal or in the coverage of the corresponding beam pattern. Therefore, the controller 220 may select the antenna having received the signal from among the plurality of directional antennae (110-1, 110-2, 110-3, 110-4) as the antenna to be used for communication.

Only the directional antenna having received the signal may be continuously turned on in operation 443. For example, if the first directional antenna 110-1 from among the plurality of directional antennae (110-1, 110-2, 110-3, 110-4) receives the signal from the peripheral vehicle 300-1, the controller 220 may switch the remaining antennae (110-2, 110-3, 110-4) off, and may provide electricity only to the first directional antenna 110-1.

If the vehicle 200 provides electricity to the first directional antenna 110-1 and transmits a response signal to the peripheral vehicle 300-1, a communication mode between the vehicle 200 and the peripheral vehicle 300-1 may be established, such that the vehicle 200 can communicate with the peripheral vehicle 300-1 through the first directional antenna 110-1 in operation 444.

The antenna apparatus, the vehicle including the same, and the method for controlling the antenna apparatus according to the above-mentioned embodiments may adjust the directional pattern to a desired direction through simple switching, without using a complicated feeding structure of the array antenna.

In addition, the above-mentioned embodiments can selectively use the omni-directional antenna supporting seamless communication or the directional antenna capable of selecting the direction of a beam pattern, such that a communication mode can be efficiently achieved.

While the present disclosure has been shown and described with reference to a few exemplary embodiments and the accompanying drawings, it will be apparent to those skilled in the art that various modifications and variations can be made in the present disclosure without departing from the spirit or scope of the disclosure. For example, adequate effects of the present disclosure may be achieved even if the foregoing processes and methods may be carried out in different order than described above, and/or the aforementioned elements, such as systems, structures, devices, or circuits, may be combined or coupled in different forms and modes than as described above or be substituted or switched with other components or equivalents.

Thus, it is intended that the present disclosure cover the modifications and variations of this disclosure provided they come within the scope of the appended claims and their equivalents.

The embodiments of the present disclosure have been disclosed herein merely for illustrative purposes, and those skilled in the art will appreciate that various modifications, additions and substitutions are possible, without departing from the scope and spirit of the disclosure as disclosed in the accompanying claims.

The terms used in the present application are merely used to describe specific embodiments and are not intended to limit the present disclosure. A singular expression may include a plural expression unless otherwise stated in the context. In the present application, the terms "including" or "having" are used to indicate that features, numbers, steps, operations, components, parts or combinations thereof described in the present specification are present and presence or addition of one or more other features, numbers, steps, operations, components, parts or combinations is not excluded.

In description of the present disclosure, the terms "first" and "second" may be used to describe various components, but the components are not limited by the terms. The terms may be used to distinguish one component from another component.

As is apparent from the above description, the antenna apparatus, the vehicle including the same, and the method for controlling the antenna apparatus according to the embodiments of the present disclosure can adjust a directional pattern toward a desired direction through simple switching without using a complicated feed structure of an array antenna.

In addition, the antenna apparatus according to the embodiments may include not only an omni-directional antenna supporting seamless communication but also a directional antenna capable of selecting the direction of a beam pattern, such that it can perform efficient communication.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An antenna apparatus comprising:

an omni-directional antenna for omni-directionally transmitting or receiving a signal; and a directional antenna module including a plurality of directional antennae having different radiation angles, wherein each of the directional antennae includes a feed unit to provide a signal, at least one waveguide through which the provided signal is propagated, and at least one radiation slot designed to radiate the signal propagated through the waveguide; and wherein the directional antenna module includes:

a top plate;

a bottom plate; and a plurality of barriers disposed between the top plate and the bottom plate so as to form a plurality of waveguides.

2. The antenna apparatus according to claim 1, wherein the plurality of directional antennae receive electricity, independently of each other.

3. The antenna apparatus according to claim 1, further comprising:

an antenna selection switch for selectively providing electricity to at least one of the plurality of directional antennae.

4. The antenna apparatus according to claim 3, further comprising:

a controller for determining a directional antenna corresponding to the position of a communication object from among the plurality of directional antennae.

5. The antenna apparatus according to claim 4, wherein the controller transmits a control signal to the antenna selection switch in such a manner that electricity is supplied to the directional antenna corresponding to the position of the communication object.

6. The antenna apparatus according to claim 4, wherein the omni-directional antenna is always ready to receive a signal from the communication object.

7. The antenna apparatus according to claim 6, wherein the controller determines the position of the communication object on the basis of positional information contained in the signal received by the omni-directional antenna.

8. The antenna apparatus according to claim 7, wherein the position information includes global positioning system (GPS) information.

9. The antenna apparatus according to claim 7, wherein the controller determines the position of the communication object whenever the controller receives a signal from the communication object.

10. The antenna apparatus according to claim 6, wherein the controller switches on the plurality of directional antennae when the omni-directional antenna receives the signal.

11. The antenna apparatus according to claim 10, wherein the controller determines the position of the communication object on the basis of the directional antenna having received the signal from among the plurality of directional antennae.

12. The antenna apparatus according to claim 11, wherein the controller switches off the directional antenna that has received no signal.

13. The antenna apparatus according to claim 12, wherein:

the controller determines whether the position of the communication object is changed on the basis of an intensity of a signal received by the switched-on directional antenna, and the controller switches on the plurality of directional antennae when the position of the communication object is changed.

14. The antenna apparatus according to claim 12, wherein:

the controller determines whether the position of the communication object is changed on the basis of a signal received by the directional antenna, and switches on another directional antenna adjacent to the directional antenna having received the signal when the position of the communication object is changed.

15. The antenna apparatus according to claim 5, wherein:

if a distance to the communication object is a short distance equal to or less than a reference distance, the controller controls the antenna selection switch to communicate with the communication object using the omni-directional antenna.

16. The antenna apparatus according to claim 1, wherein the plurality of waveguides is classified into a plurality of groups, and the plurality of groups corresponds to the plurality of directional antennae.

17. The antenna apparatus according to claim 16, further comprising:

a common ground unit located below the directional antenna module, wherein the feed unit contained in the plurality of directional antennae is connected to the common ground unit.

18. A vehicle comprising:

an omni-directional antenna for omni-directionally transmitting or receiving a signal; and a directional antenna module including a plurality of directional antennae having different radiation angles, wherein each of the directional antennae includes a feed unit for providing a signal; at least one waveguide through which the provided signal is propagated; and at least one radiation slot for radiating the signal propagated through the waveguide; and wherein the directional antenna module includes:

a top plate;

a bottom plate; and a plurality of barriers disposed between the top plate and the bottom plate so as to form a plurality of waveguides.

19. The vehicle according to claim 18, further comprising:

an antenna selection switch for selectively providing electricity to at least one of the plurality of directional antennae.

20. The vehicle according to claim 19, further comprising:

a controller for determining a directional antenna corresponding to the position of a communication object from among the plurality of directional antennae, and transmitting a control signal to the antenna selection switch in such a manner that electricity is supplied to the directional antenna corresponding to the position of the communication object.

21. The vehicle according to claim 20, wherein the omni-directional antenna is always ready to receive a signal from the communication object.

22. The vehicle according to claim 21, wherein the controller determines the position of the communication object on the basis of positional information contained in the signal received by the omni-directional antenna.

23. The vehicle according to claim 22, wherein the controller switches on the plurality of directional antennae when the omni-directional antenna receives the signal.

24. The vehicle according to claim 23, wherein the controller determines the position of the communication object on the basis of the directional antenna having received the signal from among the plurality of directional antennae.

25. The vehicle according to claim 23, wherein the controller switches off the directional antenna that has received no signal.

26. The vehicle according to claim 25, wherein:

the controller determines whether the position of the communication object is changed on the basis of an intensity of the signal received by the directional antenna, and switches on the plurality of directional antennae when the position of the communication object is changed.

27. A method for controlling an antenna apparatus, comprising:

receiving, by an omni-directional antenna staying in a standby mode, a signal from a communication object, wherein if the omni-directional antenna receives the signal, determining a directional antenna corresponding to a position of the communication object from among a plurality of directional antennae; and communicating with the communication object by switching on the determined directional antenna; and wherein the directional antenna module includes:

a top plate;

a bottom plate; and a plurality of barriers disposed between the top plate and the bottom plate so as to form a plurality of waveguides.

28. The method according to claim 27, wherein the step for determining the directional antenna corresponding to the position of the communication object includes:

using positional information of the communication object contained in the received signal.

29. The method according to claim 27, further comprising:

determining the position of the communication object when receiving the signal from the communication object.

30. The method according to claim 29, further comprising:

if the position of the communication object is changed, switching on a directional antenna corresponding to the changed position from among the plurality of directional antennae.

31. The method according to claim 27, wherein the step for determining the directional antenna corresponding to the position of the communication object includes:

switching on the plurality of directional antennae; and determining a directional antenna having received the signal from among the plurality of directional antennae to be a directional antenna corresponding to the position of the communication object.

32. The method according to claim 30, further comprising:

switching off a directional antenna that has received no signal from among the plurality of directional antennae.

33. The method according to claim 31, further comprising:

determining whether the position of the communication object is changed on the basis of an intensity of the signal received by the switched-on directional antenna; and if the position of the communication object is changed, switching on the plurality of directional antennae.

* * * * *